US009951404B2

(12) United States Patent
Bailey et al.

(10) Patent No.: US 9,951,404 B2
(45) **Date of Patent: *Apr. 24, 2018**

(54) METHODS FOR MAKING HIGH HARDNESS, HIGH TOUGHNESS IRON-BASE ALLOYS

(71) Applicant: ATI PROPERTIES LLC, Albany, OR (US)

(72) Inventors: Ronald E. Bailey, Pittsburgh, PA (US); Thomas R. Parayil, New Kensington, PA (US); Glenn J. Swiatek, Palos Heights, IL (US)

(73) Assignee: ATI PROPERTIES LLC, Albany, OR (US)

( * ) Notice: Subject to any disclaimer, the term of this patent is extended or adjusted under 35 U.S.C. 154(b) by 344 days.

This patent is subject to a terminal disclaimer.

(21) Appl. No.: 14/804,391

(22) Filed: Jul. 21, 2015

(65) Prior Publication Data

US 2015/0322554 A1 Nov. 12, 2015

Related U.S. Application Data

(63) Continuation of application No. 12/184,573, filed on Aug. 1, 2008, now Pat. No. 9,121,088.

(Continued)

(51) Int. Cl.

*C22C 38/54* (2006.01)
*C21D 9/00* (2006.01)

(Continued)

(52) U.S. Cl.

CPC ..... *C22C 38/54* (2013.01); *C21D 1/56* (2013.01); *C21D 6/004* (2013.01); *C21D 6/005* (2013.01);

(Continued)

(58) Field of Classification Search

CPC . C21D 1/56; C21D 6/004; C21D 9/42; C21D 9/46; C22C 38/44; C22C 38/005

(Continued)

(56) References Cited

U.S. PATENT DOCUMENTS 1,016,560 A 2/1912 Giolitti
1,563,420 A 12/1925 Johnson et al.

(Continued)

FOREIGN PATENT DOCUMENTS

CN 1944715 A 4/2007
CN 101906588 A 12/2010

(Continued)

OTHER PUBLICATIONS

Armox™ 600T (Armox 600S) Data Sheet, SSAB Oxelösund AB, Jun. 6, 2006.

(Continued)

*Primary Examiner* — Jie Yang
(74) *Attorney, Agent, or Firm* — K&L Gates LLP

(57) ABSTRACT

One aspect of the present disclosure is directed to low-alloy steels exhibiting high hardness and an advantageous level of multi-hit ballistic resistance with minimal crack propagation imparting a level of ballistic performance suitable for military armor applications. Certain embodiments of the steels according to the present disclosure have hardness in excess of 550 HBN and demonstrate a high level of ballistic penetration resistance relative to conventional military specifications.

25 Claims, 11 Drawing Sheets

Related U.S. Application Data

(60) Provisional application No. 60/953,269, filed on Aug. 1, 2007.

(51) Int. Cl.

| | |
|---|---|
| ***C21D 9/46*** | (2006.01) |
| ***C21D 6/00*** | (2006.01) |
| ***C22C 38/52*** | (2006.01) |
| ***C22C 38/50*** | (2006.01) |
| ***C22C 38/46*** | (2006.01) |
| ***C22C 38/06*** | (2006.01) |
| ***C22C 38/00*** | (2006.01) |
| ***C21D 1/56*** | (2006.01) |
| ***C21D 7/13*** | (2006.01) |
| ***C21D 8/02*** | (2006.01) |
| ***C21D 9/42*** | (2006.01) |
| ***C22C 38/02*** | (2006.01) |
| ***C22C 38/04*** | (2006.01) |
| ***C22C 38/44*** | (2006.01) |

(52) U.S. Cl.

CPC ..... *C21D 6/008* (2013.01); *C21D 7/13* (2013.01); *C21D 8/0226* (2013.01); *C21D 8/0263* (2013.01); *C21D 9/0075* (2013.01); *C21D 9/42* (2013.01); *C21D 9/46* (2013.01); *C22C 38/001* (2013.01); *C22C 38/005* (2013.01); *C22C 38/02* (2013.01); *C22C 38/04* (2013.01); *C22C 38/06* (2013.01); *C22C 38/44* (2013.01); *C22C 38/46* (2013.01); *C22C 38/50* (2013.01); *C22C 38/52* (2013.01)

(58) Field of Classification Search

USPC ..... 148/661

See application file for complete search history.

(56) References Cited

U.S. PATENT DOCUMENTS

| | | | | |
|---|---|---|---|---|
| 2,249,629 | A | 7/1941 | Hopkins | |
| 2,562,467 | A | 7/1951 | Kinnear, Jr. | |
| 3,379,582 | A | 4/1968 | Dickinson | |
| 3,785,801 | A | 1/1974 | Benjamin | |
| 3,888,637 | A | 6/1975 | Taguchi et al. | |
| 3,944,442 | A | 3/1976 | Donachie | |
| 4,443,254 | A | 4/1984 | Floreen | |
| 4,484,959 | A | 11/1984 | Boucher et al. | |
| 4,645,720 | A | 2/1987 | Pircher et al. | |
| 4,788,034 | A | 11/1988 | Brandis et al. | |
| 4,832,909 | A | 5/1989 | Schmidt et al. | |
| 4,871,511 | A | 10/1989 | Smith, Jr. et al. | |
| 4,917,969 | A | 4/1990 | Pircher et al. | |
| 4,941,927 | A | 7/1990 | Hickey, Jr. et al. | |
| 5,122,336 | A | 6/1992 | Roux et al. | |
| 5,129,966 | A | 7/1992 | Rao | |
| 5,268,044 | A | 12/1993 | Hemphill et al. | |
| 5,332,545 | A | 7/1994 | Love | |
| 5,720,829 | A | 2/1998 | Finkl et al. | |
| 5,749,140 | A | 5/1998 | Polito et al. | |
| 5,866,066 | A | 2/1999 | Hemphill et al. | |
| 5,997,665 | A | 12/1999 | Brisson et al. | |
| 6,080,359 | A | 6/2000 | Davidson | |
| 6,087,013 | A | 7/2000 | Chilson | |
| 6,360,936 | B1 | 3/2002 | Dilg et al. | |
| 6,361,883 | B1 | 3/2002 | Dilg et al. | |
| 7,462,251 | B2 | 12/2008 | Beguinot et al. | |
| 7,475,478 | B2 | 1/2009 | McCrink et al. | |
| 7,537,727 | B2 | 5/2009 | Dilmore et al. | |
| 7,776,162 | B2 | 8/2010 | Mizoguchi et al. | |
| 7,926,180 | B2 | 4/2011 | McCrink et al. | |
| 7,981,521 | B2 | 7/2011 | Bailey et al. | |
| 8,361,254 | B2 | 1/2013 | Bailey et al. | |
| 8,444,776 | B1 * | 5/2013 | Bailey | C21D 6/001 148/335 |
| 8,529,708 | B2 | 9/2013 | Locke | |
| 9,121,088 | B2 | 9/2015 | Bailey et al. | |
| 9,182,196 | B2 | 11/2015 | Stefansson et al. | |
| 9,593,916 | B2 * | 3/2017 | Bailey | C21D 6/001 |
| 2003/0145911 | A1 | 8/2003 | Hoffmann et al. | |
| 2011/0067788 | A1 | 3/2011 | Swiatek et al. | |
| 2012/0321504 | A1 | 12/2012 | Stefansson et al. | |
| 2013/0233454 | A1 | 9/2013 | Bailey et al. | |
| 2016/0017455 | A1 | 1/2016 | Stefansson et al. | |
| 2017/0299343 | A1 | 10/2017 | Bailey et al. | |

FOREIGN PATENT DOCUMENTS

| | | | |
|---|---|---|---|
| DE | 2142360 | A1 | 4/1972 |
| DE | 4107417 | A1 | 12/1991 |
| DE | 4344879 | A1 | 7/1995 |
| EP | 051401 | A1 | 5/1982 |
| EP | 327042 | A1 | 8/1989 |
| EP | 0731332 | A2 | 9/1996 |
| EP | 1111325 | A2 | 6/2001 |
| EP | 2036992 | A1 | 3/2009 |
| FR | 2106939 | | 5/1972 |
| GB | 763442 | | 12/1956 |
| GB | 874488 | | 8/1961 |
| GB | 2054110 | A | 2/1981 |
| JP | S47-31808 | B | 8/1972 |
| JP | S47-31809 | | 12/1972 |
| JP | S49-9899 | A | 1/1974 |
| JP | 57-41351 | A | 3/1982 |
| JP | 57-83575 | A | 5/1982 |
| JP | 58-157950 | A | 9/1983 |
| JP | 58-199846 | A | 11/1983 |
| JP | 59-6356 | A | 1/1984 |
| JP | 59-47363 | | 3/1984 |
| JP | 60-29446 | A | 2/1985 |
| JP | H01-296098 | A | 11/1989 |
| JP | 4-26738 | A | 1/1992 |
| JP | 4-26739 | A | 1/1992 |
| JP | 4-197588 | A | 7/1992 |
| JP | 07-173573 | A | 7/1995 |
| JP | 2000-31397 | A | 11/2000 |
| JP | 57-161049 | A | 10/2002 |
| RU | 2090828 | C1 | 9/1997 |
| RU | 2102688 | C1 | 1/1998 |
| RU | 2139357 | C1 | 10/1999 |
| RU | 2297460 | C1 | 4/2007 |
| RU | 2309190 | C2 | 10/2007 |
| RU | 2388986 | C2 | 5/2010 |
| SU | 404889 | | 10/1973 |
| SU | 685711 | A1 | 9/1979 |
| UA | 84607 | C2 | 11/2008 |
| WO | WO 2004/111277 | A1 | 12/2004 |
| WO | WO 2009/018522 | A1 | 2/2009 |
| WO | WO 2011/037759 | A2 | 3/2011 |
| WO | WO 2012/094160 | A2 | 7/2012 |

OTHER PUBLICATIONS

Armor Steel, Mars 300 Ni+, 2 pages.

Armor Steel, Mars 300, 4 pages.

"K12® Dual Hardness Armor Plate", Technical Data Sheet, Allegheny Ludlum, 2002.

"Allegheny Ludlum AL 600™ (UNS Designation N6600) Nickel-Base Alloy", Technical Data Blue Sheet, Allegheny Ludlum Corporation, Pittsburgh, PA, 1998.

Hickey et al., "Comparing a Split Heat of ESR/VAR 4340 Steel", Metal Progress, Oct. 1985, pp. 69-74.

"Steels Double Up for Composites," The Iron Age, Nov. 16, 1967, pp. 70-72.

Rathbone, A.M. "Review of Recent Armor Plate Developments", Blast Furnace and Steel Plant, Jul. 1968, pp. 575-583.

ATI 600-MIL® Ultra High Hard Specialty Armor; Version 4; Aug. 10, 2010.

ATI 500-MIL® High Hard Specialty Armor; Version 5; Aug. 10, 2010.

ATI-K12®-MIL Dual Hard Armor Plate; Version 3; Sep. 10, 2009.

(56) References Cited

OTHER PUBLICATIONS

ATI-K12®-MIL Dual Hard Armor Plate; Version 4; Aug. 10, 2010.
Military Specification MIL-A-12560H (MR); Nov. 28, 1990.
Military Specification MIL-DTL-32332 (MR); Jul. 24, 2009.
Military Specification MIL-DTL-46100E (MR); Jul. 9, 2008.
Military Specification MIL-DTL-12560J (MR); Jul. 24, 2009.
Military Specification MIL-A-46099C; Sep. 14, 1987.
Military Specification MIL-A-46100D (MR) with int. amendment 2; Jul. 13, 2007.
ASTM International, Standard Specification for Steel Bars, Designation: A29/A29M-05, Carbon and Alloy, Hot Wrought, General Requirements for, 2005, pp. 1-16.
Alloy Digest, Data on World Wide Metals and Alloys, AISI 4820 (Nickel-Molybdenum Carburizing Steel), Nov. 1974, 2 pages.
Data Sheet entitled "VascoMax T-200/T-250/T-300" Teledyne Vasco 1985, pp. 2-11.
Definition of "cross rolling", The Metals Handbook Desk Edition, 2nd Edition, published by ASM International of Metals Park, Ohio, 1998, p. 17.
Sulfide Inclusions in Steel, Proceedings of an International Symposium, Nov. 7-8, 1974, Port Chester, New York, pp. 206, 255-256.
Metals Handbook, Tenth Edition, vol. 1, Properties and Selection: Irons, Steels, and High-Performance Alloys, J.R. Davis, editor, published by ASM International, Materials Park, OH, 1990, p. 400.
DeArdo and E.G. Hamburg: "Influence of Elongated Inclusions on the Mechanical Properties of High Strength Steel Plate," Sulfide Inclusions in Steel, J.J. de Barbadillo and E. Snape, ed., American Society for Metals, Metals Park, OH, 1975, pp. 309-337; 359.
ASTM International, Standard Test Methods and Definitions for Mechanical Testing of Steel Products: A370-10, approved Jun. 15, 2010, published Jul. 2010, pp. 1-47.
U.S. Appl. No. 13/866,056, filed Apr. 19, 2013.
Canale, L. et al., "A Historical Overview of Steel Tempering Parameters", Dec. 31, 2008, Int. J. Microstructure and Materials Properties, vol. 3, Nos. 4/5, pp. 474-525.
Zhang et al., "Microstructure evolution of hot-work tool steels during tempering and definition of a kinetic law based on hardness measurements", Materials Science and Engineering A, 380, Mar. 22, 2004, pp. 222-230.
Crucible Selector—Crucible S7 XL, Crucible Industries, Sep. 10, 2010, 2 pages.
Hardness conversion chart downloaded from www.carbidedepot.com on Feb. 9, 2014.
Showalter et al., "Development and Ballistic Testing of a New Class of Auto-tempered High Hard Steels", ARL-TR-4997, Sep. 2009, pp. 1-36.
A Collection of Translated Essays in Heat Treatment (IV)—Vacuum Heat Treatment Special, Shanghai Institute of Machine Building Technology, Jan. 31, 1978, p. 10.

* cited by examiner

METHODS FOR MAKING HIGH HARDNESS, HIGH TOUGHNESS IRON-BASE ALLOYS

CROSS-REFERENCE TO RELATED APPLICATIONS

The present application claims priority under 35 U.S.C. § 120 as a continuation of co-pending U.S. patent application Ser. No. 12/184,573, filed Aug. 1, 2008, which in turn claims priority under 35 U.S.C. § 119(e) to U.S. Provisional Patent Application Ser. No. 60/953,269, filed Aug. 1, 2007, now lapsed.

BACKGROUND OF THE TECHNOLOGY

Field of Technology

The present disclosure relates to iron-base alloys having hardness greater than 550 HBN and demonstrating substantial and unexpected penetration resistance in standard ballistic testing, and to armor and other articles of manufacture including the alloys. The present disclosure further relates to methods of processing certain iron-base alloys so as to improve resistance to ballistic penetration.

Description of the Background of the Technology

Armor plate, sheet, and bar are commonly provided to protect structures against forcibly launched projectiles. Although armor plate, sheet, and bar are typically used in military applications as a means to protect personnel and property within, for example, vehicles and mechanized armaments, the products also have various civilian uses. Such uses include, for example, sheathing for armored civilian vehicles and blast-fortified property enclosures. Armor has been produced from a variety of materials including, for example, polymers, ceramics, and metallic alloys. Because armor is often mounted on mobile articles, armor weight is typically an important factor. Also, the costs associated with producing armor can be substantial, and particularly so in connection with exotic armor alloys, ceramics, and specialty polymers. As such, an objective has been to provide lower-cost yet effective alternatives to existing armors, and without significantly increasing the weight of armor necessary to achieve the desired level of ballistic performance (penetration resistance).

Also, in response to ever-increasing anti-armor threats, the U.S military had for many years been increasing the amount of armor used on tanks and other combat vehicles, resulting in significantly increased vehicle weight. Continuing such a trend could drastically adversely affect transportability, portable bridge-crossing capability, and maneuverability of armored combat vehicles. Within the past decade the U.S. military has adopted a strategy to be able to very quickly mobilize its combat vehicles and other armored assets to any region in the world as the need arises. Thus, concern over increasing combat vehicle weight has taken center stage. As such, the U.S. military has been investigating a number of possible alternative, lighter-weight armor materials, such as certain titanium alloys, ceramics, and hybrid ceramic tile/polymer-matrix composites (PMCs).

Examples of common titanium alloy armors include Ti-6Al-4V, Ti-6Al-4V ELI, and Ti-4Al-2.5V—Fe—O. Titanium alloys offer many advantages relative to more conventional rolled homogenous steel armor. Titanium alloys have a high mass efficiency compared with rolled homogenous steel and aluminum alloys across a broad spectrum of ballistic threats, and also provide favorable multi-hit ballistic penetration resistance capability. Titanium alloys also exhibit generally higher strength-to-weight ratios, as well as substantial corrosion resistance, typically resulting in lower asset maintenance costs. Titanium alloys may be readily fabricated in existing production facilities, and titanium scrap and mill revert can be remelted and recycled on a commercial scale. Nevertheless, titanium alloys do have disadvantages. For example, a spall liner typically is required, and the costs associated with manufacturing the titanium armor plate and fabricating products from the material (for example, machining and welding costs) are substantially higher than for rolled homogenous steel armors.

Although PMCs offer some advantages (for example, freedom from spalling against chemical threats, quieter operator environment, and high mass efficiency against ball and fragment ballistic threats), they also suffer from a number of disadvantages. For example, the cost of fabricating PMC components is high compared with the cost for fabricating components from rolled homogenous steel or titanium alloys, and PMCs cannot readily be fabricated in existing production facilities. Also, non-destructive testing of PMC materials may not be as well advanced as for testing of alloy armors. Moreover, multi-hit ballistic penetration resistance capability and automotive load-bearing capacity of PMCs can be adversely affected by structural changes that occur as the result of an initial projectile strike. In addition, there may be a fire and fume hazard to occupants in the interior of combat vehicles covered with PMC armor, and PMC commercial manufacturing and recycling capabilities are not well established.

Metallic alloys are often the material of choice when selecting an armor material. Metallic alloys offer substantial multi-hit protection, typically are inexpensive to produce relative to exotic ceramics, polymers, and composites, and may be readily fabricated into components for armored combat vehicles and mobile armament systems. It is conventionally believed that it is advantageous to use materials having very high hardnesses in armor applications because projectiles are more likely to fragment when impacting higher hardness materials. Certain metallic alloys used in armor application may be readily processed to high hardnesses, typically by quenching the alloys from very high temperatures.

Because rolled homogenous steel alloys are generally less expensive than titanium alloys, substantial effort has focused on modifying the composition and processing of existing rolled homogenous steels used in armor applications since even incremental improvements in ballistic performance are significant. For example, improved ballistic threat performance can allow for reduced armor plating thicknesses without loss of function, thereby reducing the overall weight of an armor system. Because high system weight is a primary drawback of metallic alloy systems relative to, for example, polymer and ceramic armors, improving ballistic threat performance can make alloy armors more competitive relative to exotic armor systems.

Over the last 25 years, relatively light-weight clad and composite steel armors have been developed. Certain of these composite armors, for example, combine a front-facing layer of high-hardness steel metallurgically bonded to a tough, penetration resistant steel base layer. The high-hardness steel layer is intended to break up the projectile, while the tough underlayer is intended to prevent the armor from cracking, shattering, or spalling. Conventional methods of forming a composite armor of this type include roll bonding stacked plates of the two steel types. One example of a composite armor is K12® armor plate, which is a dual hardness, roll bonded composite armor plate available from ATI Allegheny Ludlum, Pittsburgh, Pa. K12® armor plate includes a high hardness front side and a softer back side. Both faces of the K12® armor plate are Ni—Mo—Cr alloy steel, but the front side includes higher carbon content than the back side. K12® armor plate has superior ballistic performance properties compared to conventional homogenous armor plate and meets or exceeds the ballistic requirements for numerous government, military, and civilian armoring applications. Although clad and composite steel armors offer numerous advantages, the additional processing involved in the cladding or roll bonding process necessarily increases the cost of the armor systems.

Relatively inexpensive low alloy content steels also are used in certain armor applications. As a result of alloying with carbon, chromium, molybdenum, and other elements, and the use of appropriate heating, quenching, and tempering steps, certain low alloy steel armors can be produced with very high hardness properties, greater than 550 BHN (Brinell hardness number). Such high hardness steels are commonly known as "600 BHN" steels. Table 1 provides reported compositions and mechanical properties for several examples of available 600 BHN steels used in armor applications. MARS 300 and MARS 300 Ni+ are produced by the French company Arcelor. ARMOX 600T armor is available from SSAB Oxelosund AB, Sweden. Although the high hardness of 600 HBN steel armors is very effective at breaking up or flattening projectiles, a significant disadvantage of these steels is that they tend be rather brittle and readily crack when ballistic tested against, for example, armor piercing projectiles. Cracking of the materials can be problematic to providing multi-hit ballistic resistance capability.

TABLE 1

| Alloy | C | Mn | P (max) | S (max) | Si | Cr | Ni | Mo | Yield Strength (Mpa) | Tensile Strength (Mpa) | Elong. (%) | BHN (min) |
|---|---|---|---|---|---|---|---|---|---|---|---|---|
| Mars 300 | 0.45-0.55 | 0.3-0.7 | 0.012 | 0.005 | 0.6-1.0 | 0.4 (max) | 4.5 (max) | 0.3-0.5 | ≥1,300 | ≥2,000 | ≥6% | 578-655 |
| Mars 300 Ni+ | 0.45-0.55 | 0.3-0.7 | 0.01 | 0.005 | 0.6-1.0 | 0.01-0.04 | 3.5-4.5 | 0.3-0.5 | ≥1,300 | ≥2,000 | ≥6% | 578-655 |
| Armox 600 | 0.47 (max) | 1.0 (max) | 0.010 | 0.005 | 0.1-0.7 | 1.5 (max) | 3.0 (max) | 0.7 (max) | 1,500 (typical) | 2,000 (typical) | ≥7% | 570-640 |

In light of the foregoing, it would be advantageous to provide an improved steel armor material having hardness within the 600 HBN range and having substantial multi-hit ballistic resistance with reduced crack propagation.

SUMMARY

According to one non-limiting aspect of the present disclosure, an iron-base alloy is provided having favorable multi-hit ballistic resistance, hardness greater than 550 HBN, and including, in weight percentages based on total alloy weight: 0.48 to 0.52 carbon; 0.15 to 1.00 manganese; 0.15 to 0.45 silicon; 0.95 to 1.70 chromium; 3.30 to 4.30 nickel; 0.35 to 0.65 molybdenum; 0.0008 to 0.0030 boron; 0.001 to 0.015 cerium; 0.001 to 0.015 lanthanum; no greater than 0.002 sulfur; no greater than 0.015 phosphorus; no greater than 0.010 nitrogen; iron; and incidental impurities.

According to a further non-limiting aspect of the present disclosure, an alloy mill product such as, for example, a plate, a bar, or a sheet, is provided having hardness greater than 550 HBN and including, in weight percentages based on total alloy weight: 0.48 to 0.52 carbon; 0.15 to 1.00 manganese; 0.15 to 0.45 silicon; 0.95 to 1.70 chromium; 3.30 to 4.30 nickel; 0.35 to 0.65 molybdenum; 0.0008 to 0.0030 boron; 0.001 to 0.015 cerium; 0.001 to 0.015 lanthanum; no greater than 0.002 sulfur; no greater than 0.015 phosphorus; no greater than 0.010 nitrogen; iron; and incidental impurities.

According to yet another non-limiting aspect of the present disclosure, an armor mill product selected from an armor plate, an armor bar, and an armor sheet is provided having hardness greater than 550 HBN and a $V_{50}$ ballistic limit (protection) that meets or exceeds performance requirements under specification MIL-DTL-46100E. In certain embodiments the armor mill product also has a $V_{50}$ ballistic limit that is at least as great as a $V_{50}$ ballistic limit 150 ft/sec less than the performance requirements under specification MIL-A-46099C with minimal crack propagation. The mill product is an alloy including, in weight percentages based on total alloy weight: 0.48 to 0.52 carbon; 0.15 to 1.00 manganese; 0.15 to 0.45 silicon; 0.95 to 1.70 chromium; 3.30 to 4.30 nickel; 0.35 to 0.65 molybdenum; 0.0008 to 0.0030 boron; 0.001 to 0.015 cerium; 0.001 to 0.015 lanthanum; no greater than 0.002 sulfur; no greater than 0.015 phosphorus; no greater than 0.010 nitrogen; iron; and incidental impurities.

An additional aspect according to the present disclosure is directed to a method of making an alloy having favorable multi-hit ballistic resistance with minimal crack propagation and hardness greater than 550 HBN, and wherein the mill product is an alloy including, in weight percentages based on total alloy weight: 0.48 to 0.52 carbon; 0.15 to 1.00 manganese; 0.15 to 0.45 silicon; 0.95 to 1.70 chromium; 3.30 to 4.30 nickel; 0.35 to 0.65 molybdenum; 0.0008 to 0.0030 boron; 0.001 to 0.015 cerium; 0.001 to 0.015 lanthanum; no greater than 0.002 sulfur; no greater than 0.015 phosphorus; no greater than 0.010 nitrogen; iron; and incidental impurities. The alloy is austenitized by heating the alloy to a temperature of at least 1500° F. and holding for at least 30 minutes time-at-temperature. The alloy is then cooled from the austenitizing temperature in a manner that differs from the conventional manner of cooling armor alloy from the austenitizing temperature and which alters the path of the cooling curve of the alloy relative to the path the curve would assume if the alloy were cooled in a conventional manner. Preferably, cooling the alloy from the austenitizing temperature provides the alloy with a $V_{50}$ ballistic limit that meets or exceeds the required $V_{50}$ under specification MIL-DTL-46100E.

More preferably, cooling the alloy from the austenitizing temperature provides the alloy with a $V_{50}$ ballistic limit that is no less than 150 ft/sec less than the required $V_{50}$ under specification MIL-A-46099C with minimal crack propagation. In other words, the $V_{50}$ ballistic limit preferably is at least as great as a $V_{50}$150 ft/sec less than the required $V_{50}$ under specification MIL-A-46099C with minimal crack propagation According to one non-limiting embodiment of a method according to the present disclosure, the step of cooling the alloy comprises simultaneously cooling multiple plates of the alloy from the austenitizing temperature with the plates arranged in contact with one another.

Other aspects of the present disclosure are directed to articles of manufacture comprising embodiments of alloys according to the present disclosure. Such articles of manufacture include, for example, armored vehicles, armored enclosures, and items of armored mobile equipment.

BRIEF DESCRIPTION OF THE DRAWINGS

Features and advantages of certain of the alloys, articles, and methods according to the present disclosure may be better understood by reference to the accompanying drawings in which.

Figure 1:
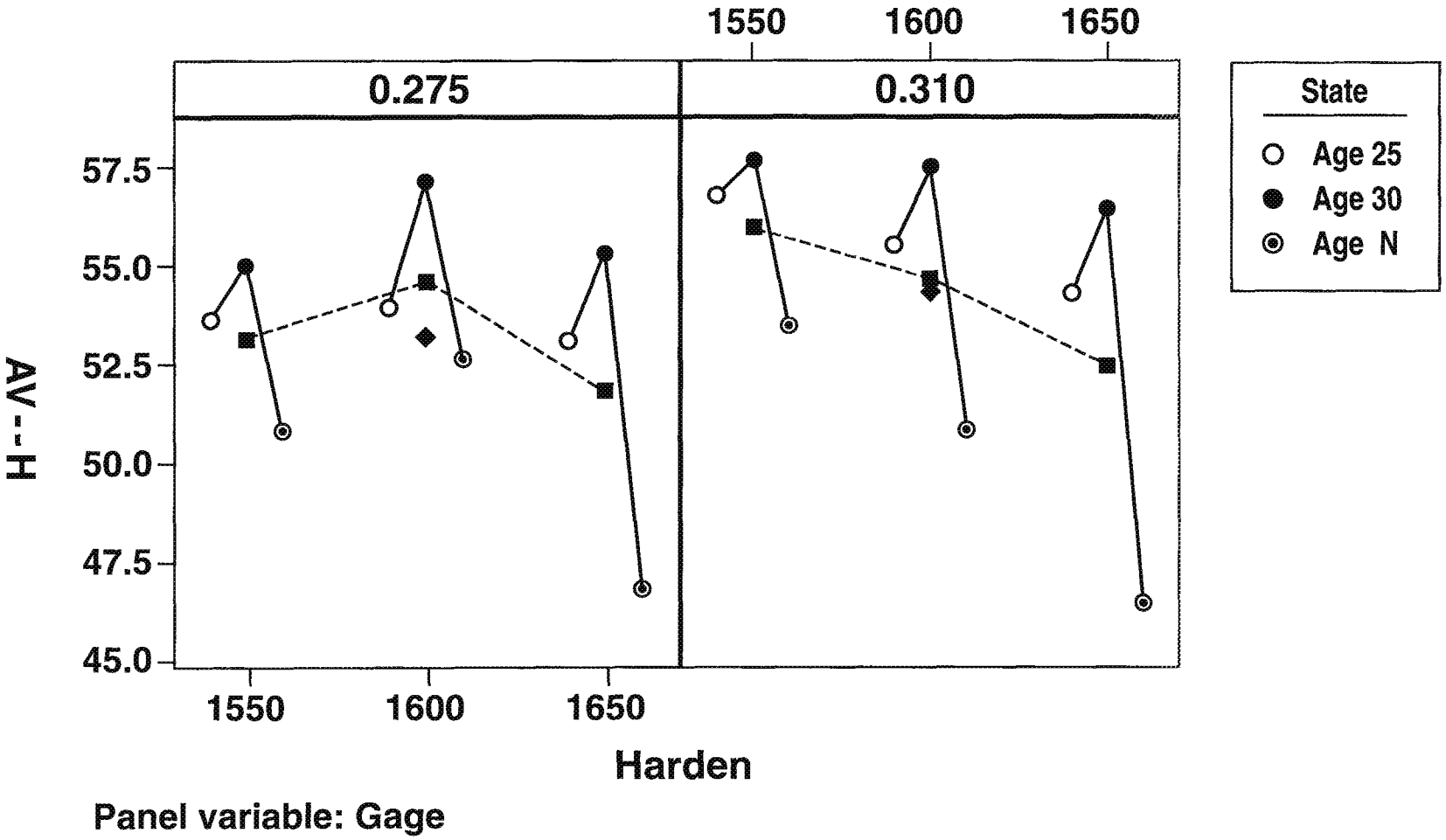
FIG. 1 is a plot of $HR_C$ hardness as a function of austenitizing treatment heating temperature for certain experimental plate samples processed as described hereinbelow.

The reader will appreciate the foregoing details, as well as others, upon considering the following detailed description of certain non-limiting embodiments of alloys articles and methods according to the present disclosure. The reader also may comprehend certain of such additional details upon carrying out or using the alloys, articles and methods described herein.

DETAILED DESCRIPTION OF CERTAIN NON-LIMITING EMBODIMENTS

In the present description of non-limiting embodiments, other than in the operating examples or where otherwise indicated, all numbers expressing quantities or characteristics of ingredients and products, processing conditions, and the like are to be understood as being modified in all instances by the term "about". Accordingly, unless indicated to the contrary, any numerical parameters set forth in the following description are approximations that may vary depending upon the desired properties one seeks to obtain in the alloys and articles according to the present disclosure. At the very least, and not as an attempt to limit the application of the doctrine of equivalents to the scope of the claims, each numerical parameter should at least be construed in light of the number of reported significant digits and by applying ordinary rounding techniques.

Any patent, publication, or other disclosure material, in whole or in part, that is said to be incorporated by reference herein is incorporated herein only to the extent that the incorporated material does not conflict with existing definitions, statements, or other disclosure material set forth in this disclosure. As such, and to the extent necessary, the disclosure as set forth herein supersedes any conflicting material incorporated herein by reference. Any material, or portion thereof, that is said to be incorporated by reference herein, but which conflicts with existing definitions, statements, or other disclosure material set forth herein is only incorporated to the extent that no conflict arises between that incorporated material and the existing disclosure material.

The present disclosure, in part, is directed to low-alloy steels having significant hardness and demonstrating a substantial and unexpected level of multi-hit ballistic resistance with minimal crack propagation imparting a level of ballistic penetration resistance suitable for military armor applications. Certain embodiments of the steels according to the present disclosure exhibit hardness values in excess of 550 HBN and demonstrate a substantial level of ballistic penetration resistance when evaluated as per MIL-DTL-46100E, and preferably also when evaluated per MIL-A-46099C. Relative to certain existing 600 BHN steel armor plate materials, certain embodiments of the alloys according to the present disclosure are significantly less susceptible to cracking and penetration when tested against armor piercing projectiles. Certain embodiments of the alloys also have demonstrated ballistic performance that is comparable to the performance of certain high-alloy armor materials, such as K-12® armor plate. The ballistic performance of certain embodiments of steel alloys according to the present disclosure was wholly unexpected given, for example, the low alloy content of the alloys and the alloys' relatively moderate hardness compared with certain conventional 600 BHN steel armor materials. More particularly, it was unexpectedly observed that although certain embodiments of alloys according to the present disclosure exhibit relatively moderate hardnesses (which can be provided by cooling the alloys from austenitizing temperatures at a relatively slow cooling rate), the samples of the alloys exhibited substantial ballistic performance, which was at least comparable to the performance of K-12® armor plate. This surprising and unobvious discovery runs directly counter to the conventional belief that increasing the hardness of steel armor plate materials improves ballistic performance.

Certain embodiments of steels according to the present disclosure include low levels of the residual elements sulfur, phosphorus, nitrogen, and oxygen. Also, certain embodiments of the steels may include concentrations of one or more of cerium, lanthanum, and other rare earth metals. Without being bound to any particular theory of operation, the inventors believe that the rare earth additions act to bind some portion of sulfur, phosphorus, and/or oxygen present in the alloy so that these residuals are less likely to concentrate in grain boundaries and reduce the multi-hit ballistic resistance of the material. It is further believed that concentrating sulfur, phosphorus, and/or oxygen within the steels' grain boundaries can promote intergranular separation upon high velocity impact, leading to material fracture and possible penetration of the impacting projectile. Certain embodiments of the steels according to the present disclosure also include relatively high nickel content, for example 3.30 to 4.30 weight percent, to provide a relatively tough matrix, thereby significantly improving ballistic performance.

1. Preparation of Experimental Alloy Plates

A novel composition for low-alloy steel armors was formulated. The present inventors concluded that such alloy composition preferably should include relatively high nickel content and low levels of sulfur, phosphorus, and nitrogen residual elements, and should be processed to plate form in a way that promotes homogeneity. Several ingots of an alloy having the experimental chemistry shown in Table 2 were prepared by AOD or AOD and ESR. Table 2 indicates the desired minimum and maximum, preferred minimum and preferred maximum (if any), and aim levels of the alloying ingredients, as well as the actual chemistry of the alloy produced. The balance of the alloy included iron and incidental impurities. Non-limiting examples of elements that may be present as incidental impurities include copper, aluminum, titanium, tungsten, and cobalt. Other potential incidental impurities, which may be derived from the starting materials and/or through alloy processing, will be known to persons having ordinary skill in metallurgy. Alloy compositions are reported in Table 2, and more generally are reported herein, as weight percentages based on total alloy weight unless otherwise indicated. Also, in Table 2, "LAP" refers to "low as possible".

TABLE 2

| | C | Mn | P | S | Si | Cr | Ni | Mo | Ce | La | V | W | Ti | Co | Al | N | B |
|---|---|---|---|---|---|---|---|---|---|---|---|---|---|---|---|---|---|
| Min. | .48 | .15 | — | — | .15 | .95 | 3.30 | .35 | .001 | .001 | — | — | — | — | — | — | .0008 |
| Max. | .52 | 1.00 | .015 | .002 | .45 | 1.70 | 4.30 | .65 | .015 | .015 | .05 | .08 | .05 | .05 | .020 | .010 | .0024 |
| Preferred Min. | — | .20 | — | — | .20 | 1.00 | 3.75 | .40 | — | — | — | — | — | — | — | — | .0015 |
| Preferred Max. | — | .80 | .010 | — | .40 | 1.50 | 4.25 | .60 | — | — | — | — | — | — | — | — | .0025 |
| Aim | .50 | .50 | LAP | LAP | .30 | 1.25 | 4.00 | .50 | — | — | LAP | LAP | LAP | LAP | LAP | LAP | .0016 |
| Actual* | .50 | .53 | .01 | .0006 | 0.4 | 1.24 | 4.01 | .52 | — | .003 | .01 | .01 | .002 | .02 | .02 | .007 | .0015 |

*Analysis revealed that the composition also included 0.09 copper, 0.004 niobium, 0.004 tin, 0.001 zirconium, and 92.62 iron.

In addition to developing a unique alloy system, the inventors also conducted studies, discussed below, to determine how one may process steels within the present disclosure to improve hardness and ballistic performance as evaluated per known military specifications MIL-DTL-46100E and MIL-A-46099C. The inventors also subjected samples of steel according to the present disclosure to various temperatures intended to dissolve carbide particles within the steel and to allow diffusion and produce a reasonable degree of homogeneity within the steel. An objective of this testing was to determine heat treating temperatures that do not produce excessive carburization or result in excessive and unacceptable grain growth, which would reduce material toughness and thereby degrade ballistic performance. In certain processes, the plates of the steel were cross rolled to provide some degree of isotropy.

Trials evaluating the ballistic performance of samples cooled at different rates from austenitizing temperature, and therefore having differing hardnesses, also were conducted. The inventors' testing also included tempering trials and cooling trials intended to assess how best to promote multi-hit ballistic resistance with minimal crack propagation. Samples were evaluated by determining $V_{50}$ ballistic limits of the various test samples per MIL-DTL-46100E and MIL-A-46099C using 7.62 mm (.30 caliber) armor piercing projectiles. Details of the inventors' alloy studies follow.

Ingot surfaces were ground using conventional practices. The ingots were then heated to about 1300° F. (704° C.), equalized, held at this first temperature for 6 to 8 hours, heated at about 200° F./hour (93° C./hour) up to about 2050° F. (1121° C.), and held at the second temperature for about 30 minutes per inch of thickness. Ingots were then hot rolled to 7 inch (17.8 cm) thickness, end cropped and, if necessary, reheated to about 2050° F. (1121° C.) before subsequent additional hot rolling to reslabs of about 1.50-2.50 inches (38.1-63.5 cm) in thickness. The reslabs were stress relief annealed using conventional practices, and slab surfaces were then blast cleaned and finish rolled to long plates having thicknesses of either about 0.310 inch (7.8 mm) or about 0.275 inch (7 mm). The long plates were then fully annealed, blast cleaned, flattened, and sheared to form multiple individual plates having a thickness of either about 0.310 inch (7.8 mm) or about 0.275 inch (7 mm).

In certain cases, the reslabs were reheated to rolling temperature immediately before the final rolling step necessary to achieve finished gauge. More specifically, the plate samples were final rolled as shown in Table 3. Tests were conducted on samples of the 0.0275 and 0.310 inch (7 and 7.8 mm) gauge (nominal) plates that were final rolled as shown in Table 3 to assess possible heat treatment parameters optimizing surface hardness and ballistic performance properties.

TABLE 3

| Approx. Thickness, inch (mm) | Hot Rolling Process Parameters |
|---|---|
| 0.275 (7) | Reheated slab at 0.5 for approx. 10 min. before rolling to finish gauge |
| 0.275 (7) | No re-heat immediately before rolling to finish gauge |

TABLE 3-continued

| Approx. Thickness, inch (mm) | Hot Rolling Process Parameters |
|---|---|
| 0.310 (7.8) | Reheated slab at 0.6 for approx. 30 min. before rolling to finish gauge |
| 0.310 (7.8) | No re-heat immediately before rolling to finish gauge |

2. Hardness Testing

Plates produced as in Section 1 above were subjected to an austenitizing treatment and a hardening step, cut into thirds to form samples for further testing and, optionally, subjected to a tempering treatment. The austenitizing treatment involved heating the samples to 1550-1650° F. (843-899° C.) for 40 minutes time-at-temperature. Hardening involved air-cooling the samples or quenching the samples in oil from the austenitizing treatment temperature to room temperature ("RT"). One of the three samples from each austenitized and hardened plate was retained in the as-hardened state for testing. The remaining two samples cut from each austenitized and hardened plate were temper annealed by holding at either 250° F. (121° C.) or 300° F. (149° C.) for 90 minutes time-at-temperature. To reduce the time needed to evaluate sample hardness, all samples were initially tested using the Rockwell C ($HR_C$) test rather than the Brinell hardness test. The two samples exhibiting the highest $HR_C$ values in the as-hardened state were also tested to determine Brinell hardness (BHN) in the as-hardened state (i.e., before any tempering treatment). Table 4 lists austenitizing treatment temperatures, quench type, gauge, and $HR_C$ values for samples tempered at either 250° F. (121° C.) or 300° F. (149° C.). Table 4 also indicates whether the plates used in the testing were subjected to reheating immediately prior to rolling to final gauge. In addition, Table 4 lists BHN hardness for the untempered, as-hardened samples exhibiting the highest $HR_C$ values in the as-hardened condition.

TABLE 4

| Aus. Anneal Temp. (° F.) | Cooling Type | Reheat | Gauge | As-Hardened $HR_c$ | As-Hardened BHN | $HR_c$ Post 250° F. Anneal | $HR_c$ Post 300° F. Anneal |
|---|---|---|---|---|---|---|---|
| 1550 | Air | No | 0.275 | 50 | — | 54 | 54 |
| 1550 | Air | No | 0.310 | 53 | — | 58 | 57 |
| 1550 | Air | Yes | 0.275 | 50 | — | 53 | 56 |
| 1550 | Air | Yes | 0.310 | 50 | — | 55 | 57 |
| 1550 | Oil | No | 0.275 | 48 | — | 54 | 56 |
| 1550 | Oil | No | 0.310 | 53 | — | 58 | 58 |
| 1550 | Oil | Yes | 0275 | 59 | 624 | 52 | 53 |
| 1550 | Oil | Yes | 0.310 | 59 | — | 55 | 58 |
| 1600 | Air | No | 0.275 | 53 | 587 | 54 | 57 |
| 1600 | Air | No | 0.310 | 48 | — | 56 | 57 |
| 1600 | Air | Yes | 0.275 | 54 | — | 56 | 57 |
| 1600 | Air | Yes | 0.310 | 50 | — | 57 | 58 |
| 1600 | Oil | No | 0.275 | 53 | — | 54 | 57 |
| 1600 | Oil | No | 0.310 | 52 | — | 55 | 58 |
| 1600 | Oil | Yes | 0.275 | 51 | — | 51 | 58 |
| 1600 | Oil | Yes | 0.310 | 53 | — | 53 | 58 |
| 1650 | Air | No | 0.275 | 46 | — | 54 | 56 |
| 1650 | Air | No | 0.310 | 46 | — | 53 | 56 |
| 1650 | Air | Yes | 0.275 | 48 | — | 53 | 57 |
| 1650 | Air | Yes | 0.310 | 48 | — | 54 | 56 |
| 1650 | Oil | No | 0.275 | 47 | — | 52 | 55 |
| 1650 | Oil | No | 0.310 | 46 | — | 54 | 57 |
| 1650 | Oil | Yes | 0.275 | 46 | — | 55 | 54 |
| 1650 | Oil | Yes | 0.310 | 47 | — | 57 | 58 |

Table 5 provides average $HR_C$ values for the samples included in Table 4 in the as-hardened state and after temper anneals of either 250° F. (121° C.) or 300° F. (149° C.) for 90 minutes time-at-temperature.

TABLE 5

| Austenitizing Anneal Temp. (° F.) | Avg. $HR_c$ As-Hardened | Avg. $HR_c$ Post 250° F. Anneal | Avg. $HR_c$ Post 300° F. Anneal |
|---|---|---|---|
| 1550 | 52 | 55 | 56 |
| 1600 | 52 | 55 | 57 |
| 1650 | 47 | 54 | 56 |

In general, Brinell hardness is determined per specification ASTM E-10 by forcing an indenter in the form of a hard steel or carbide sphere of a specified diameter under a specified load into the surface of the sample and measuring the diameter of the indentation left after the test. The Brinell hardness number or "BHN" is obtained by dividing the indenter load used (in kilograms) by the actual surface area of the indentation (in square millimeters). The result is a pressure measurement, but the units are rarely stated when BHN values are reported.

In assessing the Brinell hardness number of steel armor samples, a desk top machine is used to press a 10 mm diameter tungsten carbide sphere indenter into the surface of the test specimen. The machine applies a load of 3000 kilograms, usually for 10 seconds. After the ball is retracted, the diameter of the resulting round impression is deter mined. The BHN value is calculated according to the following formula:

$$BHN=2P/[\pi D(D-(D^2-d^2)^{1/2})],$$

where BHN=Brinell hardness number; P=the imposed load in kilograms; D=the diameter of the spherical indenter in mm; and d=the diameter of the resulting indenter impression in mm.

Several BHN tests may be carried out on a surface region of an armor plate and each test might result in a slightly different hardness number. This variation in hardness can be due to minor variations in the local chemistry and microstructure of the plate since even homogenous armors are not absolutely uniform. Small variations in hardness measures also can result from errors in measuring the diameter of the indenter impression on the specimen. Given the expected variation of hardness measurements on any single specimen, BHN values often are provided as ranges, rather than as single discrete values.

As shown in Table 4, the highest Brinell hardnesses measured for the samples were 624 and 587. Those particular as-hardened samples were austenitized at 1550° F. (843° C.) (BHN 624) or 1600° F. (871° C.) (BHN 587). One of the two samples was oil quenched (BHN 624), and the other was air-cooled, and only one of the two samples (BHN 624) was reheated prior to rolling to final gauge.

In general, it was observed that using a temper anneal tended to increase sample hardness, with a 300° F. (149° C.) tempering temperature resulting in the greater hardness increase at each austenitizing temperature. Also, it was observed that increasing the austenitizing temperature generally tended to decrease the final hardness achieved. These correlations are illustrated in FIG. 1, which plots average $HR_C$ hardness as a function of austenitizing temperature for 0.275 inch (7 mm) samples (left panel) and 0.310 inch (7.8 mm) samples (right panel) in the as-hardened state ("AgeN") or after tempering at either 250° F. (121° C.) ("Age25") or 300° F. (149° C.) ("Age30").

Figure 2:
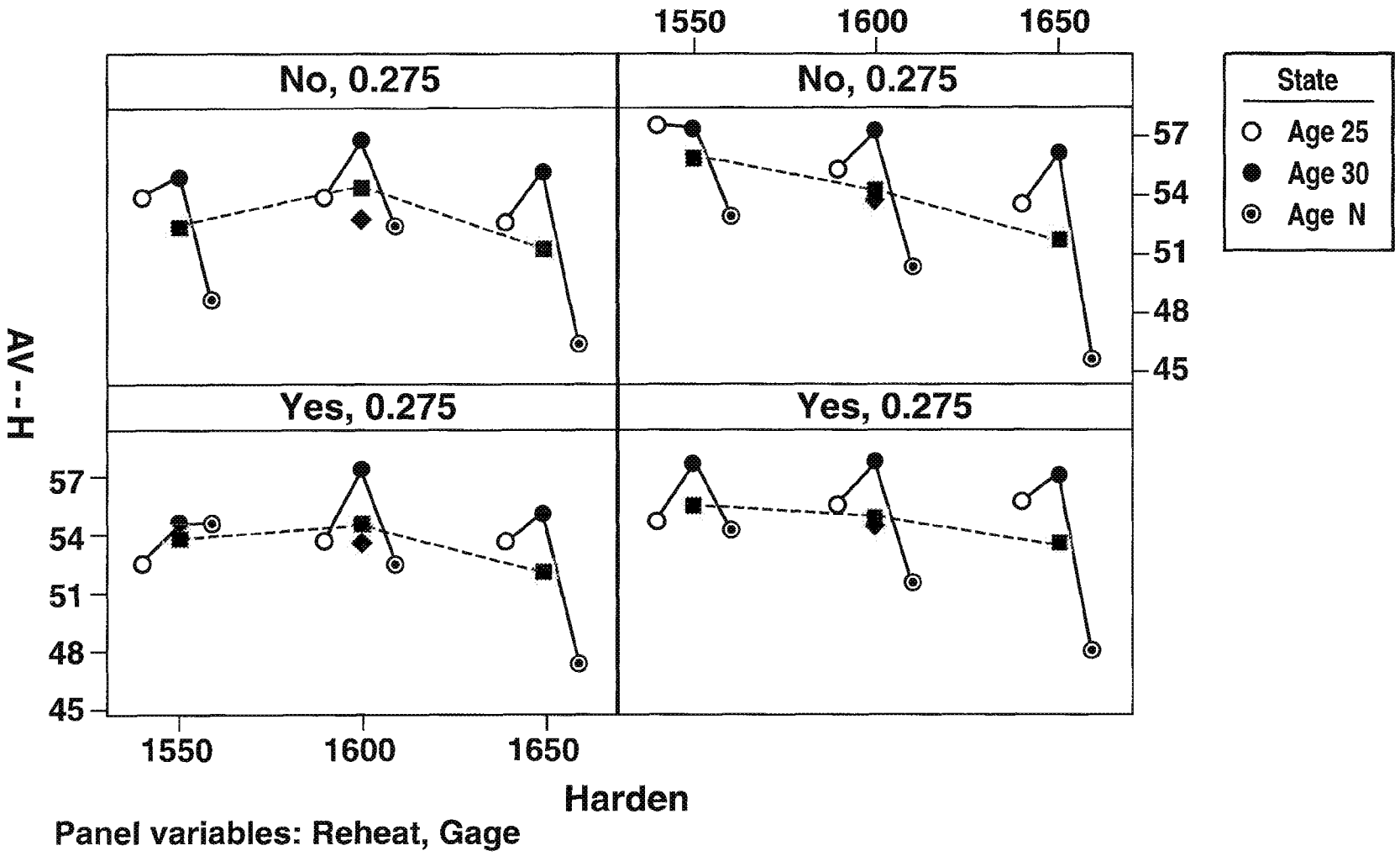
FIG. 2 is a plot of $HR_C$ hardness as a function of austenitizing treatment heating temperature for certain non-limiting experimental plate samples processed as described hereinbelow.
Figure 3:
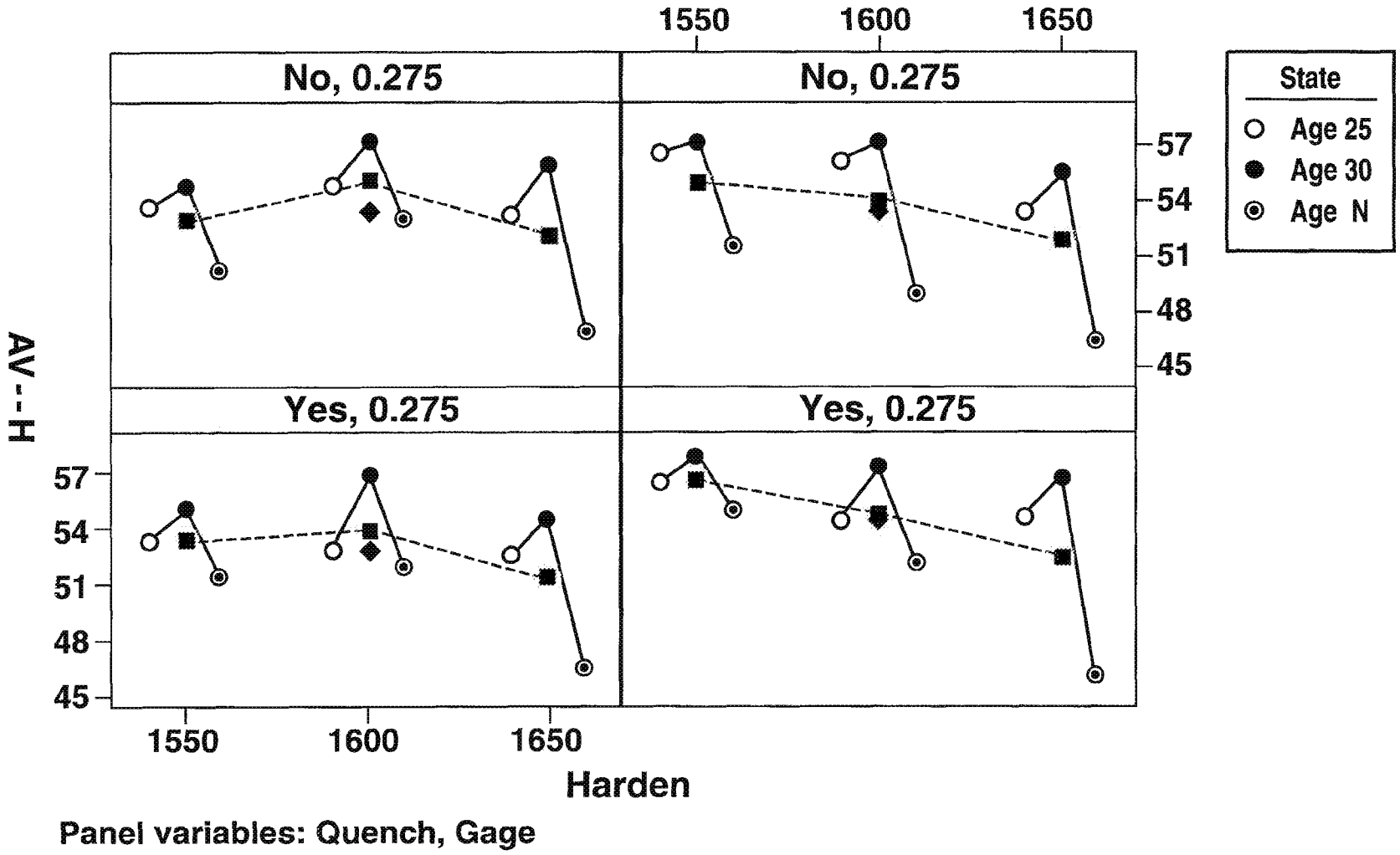
FIG. 3 is a plot of $HR_C$ hardness as a function of austenitizing treatment heating temperature for certain non-limiting experimental plate samples processed as described hereinbelow.

FIGS. 2 and 3 consider the effects on hardness of quench type and whether the reslabs were reheated prior to rolling to 0.275 and 0.310 inch (7 and 7.8 mm) nominal final gauge. FIG. 2 plots $HR_C$ hardness as a function of austenitizing temperature for non-reheated 0.275 inch (7 mm) samples (upper left panel), reheated 0.275 inch (7 mm) samples (lower left panel), non-reheated 0.310 inch (7.8 mm) samples (upper right panel), and reheated 0.310 inch (7.8 mm) samples (lower right panel) in the as-hardened state ("AgeN") or after tempering at either 250° F. (121° C.) ("Age25") or 300° F. (149° C.) ("Age30"). Similarly, FIG. 3 plots $HR_C$ hardness as a function of austenitizing temperature for air-cooled 0.275 inch (7 mm) samples (upper left panel), oil-quenched 0.275 inch (7 mm) samples (lower left panel), air-cooled 0.310 inch (7.8 mm) samples (upper right panel), and oil-quenched 0.310 inch (7.8 mm) samples (lower right panel) in the as-hardened state ("AgeN") or after tempering at either 250° F. (121° C.) ("Age25") or 300° F. (149° C.) ("Age30"). The average hardness of samples processed at each of the austenitizing temperatures and satisfying the conditions pertinent to each of the panels in FIGS. 2 and 3 is plotted in each panel as a square-shaped data point, and each such data point in each panel is connected by dotted lines so as to better visualize any trend. The overall average hardness of all samples considered in each panel of FIGS. 2 and 3 is plotted in each panel as a diamond-shaped data point.

With reference to FIG. 2, it was generally observed that the hardness effect of reheating prior to rolling to final gauge was minor and not evident relative to the effect of other variables. For example, only one of the samples with the highest two Brinell hardnesses had been reheated prior to rolling to final gauge. With reference to FIG. 3, it was generally observed that any hardness difference resulting from using an air cool versus an oil quench after the austenitizing heat treatment was minimal. For example, only one of the samples with the highest two Brinell hardnesses had been reheated in plate form prior to rolling to final gauge.

It was determined that the experimental alloy samples included a high concentration of retained austenite after the austenitizing anneals. Greater plate thickness and higher austenitizing treatment temperatures tended to produce greater retained austenite levels. Also, it was observed that at least some portion of the austenite transformed to martensite during the temper annealing. Any untempered martensite present after the temper annealing treatment may lower the toughness of the final material. To better ensure optimum toughness, it was concluded that an additional temper anneal could be used to further convert any retained austenite to martensite. Based on the inventors' observations, an austenitizing temperature of at least about 1500° F. (815° C.), more preferably at least about 1550° F. (843° C.) appears to be satisfactory for the articles evaluated in terms of achieving high hardnesses.

3. Ballistic Performance Testing

Several 18×18 inch (45.7×45.7 cm) test panels having a nominal thickness of 0.275 inch (7 mm) were prepared as described in Section 1 above, and then further processed as discussed below. The panels were then subjected to ballistic performance testing as described below.

Eight test panels produced as described in Section 1 were further processed as follows. The eight panels were austenitized at 1600° F. (871° C.) for 35 minutes (+/−5 minutes), allowed to air cool to room temperature, and hardness tested. The BHN hardness of one of the eight panels austenitized at 1600° F. (871° C.) was determined after air cooling in the as-austenitized, un-tempered ("as-hardened") condition. The as-hardened panel exhibited a hardness of about 600 BHN.

Six of the eight panels austenitized at 1600° F. (871° C.) and air cooled were divided into three sets of two, and each set was tempered at one of 250° F. (121° C.), 300° F. (149° C.), and 350° F. (177° C.) for 90 minutes (+/−5 minutes), air cooled to room temperature, and hardness tested. One panel of each of the three sets of tempered panels (three panels total) was set aside, and the remaining three tempered panels were re-tempered at their original 250° F. (121° C.), 300° F. (149° C.), or 350° F. (177° C.) tempering temperature for 90 minutes (+/−5 minutes), air cooled to room temperature, and hardness tested. These six panels are identified in Table 6 below by samples ID numbers 1 through 6.

One of the eight panels austenitized at 1600° F. (871° C.) and air cooled was immersed in 32° F. (0° C.) ice water for approximately 15 minutes and then removed and hardness tested. The panel was then tempered at 300° F. (149° C.) for 90 minutes (+/−5 minutes), air cooled to room temperature, immersed in 32° F. (0° C.) ice water for approximately 15 minutes, and then removed and hardness tested. The sample was then re-tempered at 300° F. (149° C.) for 90 minutes (+/−5 minutes), air cooled to room temperature, again placed in 32° F. (0° C.) ice water for approximately 15 minutes, and then again removed and hardness tested. This panel is referenced in Table 6 by ID number 7.

Three additional test panels prepared as described in Section 1 above were further processed as follows and then subjected to ballistic performance testing. Each of the three panels was austenitized at 1950° F. (1065° C.) for 35 minutes (+/−5 minutes), allowed to air cool to room temperature, and hardness tested. Each of the three panels was next tempered at 300° F. for 90 minutes (+/−5 minutes), air cooled to room temperature, and hardness tested. Two of three tempered, air-cooled panels were then re-tempered at 300° F. (149° C.) for 90 minutes (+/−5 minutes), air cooled, and then tested for hardness. One of the re-tempered panels was next cryogenically cooled to −120° F. (−84° C.), allowed to warm to room temperature, and hardness tested. These three panels are identified by ID numbers 9-11 in Table 6.

The eleven panels identified in Table 6 were individually evaluated for ballistic performance by assessing $V_{50}$ ballistic limit (protection) using 7.62 mm (.30 caliber) M2 AP projectiles as per MIL-DTL-46100E. The $V_{50}$ ballistic limit is the calculated projectile velocity at which the probability is 50% that the projectile will penetrate the armor test panel.

More precisely, under U.S. military procurement specification MIL-DTL-46100E ("Armor, Plate, Steel, Wrought, High Hardness"), the $V_{50}$ ballistic limit (protection) is the average velocity of six fair impact velocities comprising the three lowest projectile velocities resulting in complete penetration and the three highest projectile velocities resulting in partial penetration. A maximum spread of 150 feet/second (fps) is permitted between the lowest and highest velocities employed in determining $V_{50}$. In cases where the lowest complete penetration velocity is lower than the highest partial penetration velocity by more than 150 fps, the ballistic limit is based on ten velocities (the five lowest velocities that result in complete penetration and the five highest velocities that result in partial penetrations). When the ten-round excessive spread ballistic limit is used, the velocity spread must be reduced to the lowest partial level, and as close to 150 fps as possible. The normal up and down firing method is used in determining $V_{50}$ ballistic limit (protection), all velocities being corrected to striking velocity. If the computed $V_{50}$ ballistic limit is less than 30 fps above the minimum required and if a gap (high partial penetration velocity below the low complete penetration velocity) of 30 fps or more exists, projectile firing is continue as needed to reduce the gap to 25 fps or less.

The $V_{50}$ ballistic limit calculated for a test panel may be compared with the required minimum $V_{50}$ for the particular thickness of the test panel. If the calculated $V_{50}$ for the test panel exceeds the required minimum $V_{50}$, then it may be said that the test panel has "passed" the requisite ballistic performance criteria. Minimum $V_{50}$ ballistic limit values for plate armor are set out in various U.S. military specifications, including MIL-DTL-46100E and MIL-A-46099C ("Armor Plate, Steel, Roll-Bonded, DNAL Hardness (0.187 Inches To 0.700 Inches Inclusive")).

Table 6 lists the following information for each of the eleven ballistic test panels: sample ID number; austenitizing temperature; BHN hardness after cooling to room temperature from the austenitizing treatment ("as-hardened"); tempering treatment parameters (if used); BHN hardness after cooling to room temperature from the tempering temperature; re-tempering treatment parameters (if used); BHN hardness after cooling to room temperature from the re-tempering temperature; and the difference in fps between the panel's calculated ballistic limit $V_{50}$ and the required minimum $V_{50}$ ballistic limit as per MIL-DTL-46100E and as per MIL-A-46099C. Positive $V_{50}$ difference values in Table 6 (e.g., "+419") indicate that the calculated $V_{50}$ ballistic limit for a panel exceeded the required $V_{50}$ by the indicated extent. Negative difference values (e.g., "−44") indicate that the calculated $V_{50}$ for the panel was less than the required $V_{50}$ per the indicated military specification by the indicated extent.

TABLE 6

| ID | Aus. Temp. (° F.) | As-Hardened Hardness (BHN) | Temper (minutes @ ° F.) | Post-Temper Hardness (BHN) | Re-Temper (minutes @ ° F.) | Post Re-Temper Hardness (BHN) | Re-Temper (minutes @ ° F.) | Post Re-Temper Hardness (BHN) | $V_{50}$ versus 46100E (fps) | $V_{50}$ versus 46099C (fps) |
|---|---|---|---|---|---|---|---|---|---|---|
| 1 | 1600 | 600 | 90@250 | 600 | NA | NA | NA | NA | +419 | +37 |
| 2 | 1600 | 600 | 90@250 | 600 | 90@250 | 600 | NA | NA | +341 | −44 |
| 3 | 1600 | 600 | 90@300 | 600 | NA | NA | NA | NA | +309 | −74 |
| 4 | 1600 | 600 | 90@300 | 600 | 90@300 | 600 | NA | NA | +346 | −38 |
| 5 | 1600 | 600 | 90@350 | 578 | NA | NA | NA | NA | +231 | −153 |
| 6 | 1600 | 600 | 90@350 | 578 | 90@350 | 578 | NA | NA | +240 | −144 |
| 7 | 1600 | 600 | 15@32 | 600 | 90@300 + AC + 15@32 | 600 | 90@300 + AC + 15@32 | 600 | +372 | −16 |
| 8 | 1950 | 555 | 90@300 | 555 | NA | NA | NA | NA | +243 | −137 |
| 9 | 1950 | 555 | 90@300 | 555 | 90@300 | 555 | NA | NA | +234 | −147 |
| 10 | 1950 | 555 | 90@300 | — | 90@300 | — | −120 | — | — | — |

Eight additional 18×18 inch (45.7×45.7 cm) (nominal) test panels, numbered 12-19, composed of the experimental alloy were prepared as described in Section 1 above. Each of the panels was nominally either 0.275 inch (7 mm) or 0.320 inch (7.8 mm) in thickness. Each of the eight panels was subjected to an austenitizing treatment by heating at 1600° F. (871° C.) for 35 minutes (+/−5 minutes) and then air cooled to room temperature. Panel 12 was evaluated for ballistic performance in the as-hardened state (as-cooled, with no temper treatment) against 7.62 mm (.30 caliber) M2 AP projectiles. Panels 13-19 were subjected to the individual tempering steps listed in Table 7, air cooled to room temperature, and then evaluated for ballistic performance in the same way as panels 1-11 above. Each of the tempering times listed in Table 7 are approximations and were actually within +/−5 minutes of the listed durations. Table 8 lists the calculated $V_{50}$ ballistic limit (performance) of each of test panels 12-19, along with the required minimum $V_{50}$ as per MIL-DTL-46100E and as per MIL-A-46099C for the particular panel thickness listed in Table 7.

TABLE 7

| ID | Gauge (inch) | No Temper | Temper @ 175° F. for 60 minutes | Temper @ 200° F. for 60 minutes | Temper @ 225° F. for 60 minutes | Temper @ 250° F. for 30 minutes | Temper @ 250° F. for 60 minutes | Temper @ 250° F. for 90 minutes | Temper @ 250° F. for 120 minutes |
|---|---|---|---|---|---|---|---|---|---|
| 12 | 0.282 | X | | | | | | | |
| 13 | 0.280 | | X | | | | | | |
| 14 | 0.281 | | | X | | | | | |
| 15 | 0.282 | | | | X | | | | |
| 16 | 0.278 | | | | | X | | | |
| 17 | 0.278 | | | | | | X | | |
| 18 | 0.285 | | | | | | | X | |
| 19 | 0.281 | | | | | | | | X |

TABLE 8

| Sample ID | Calculated $V_{50}$ Ballistic Limit (fps) | Min. $V_{50}$ Ballistic Limit per MIL-DTL-46100E (fps) | Min. $V_{50}$ Ballistic Limit per MIL-A-46099C (fps) |
|---|---|---|---|
| 12 | 2936 | 2426 | 2807 |
| 13 | 2978 | 2415 | 2796 |
| 14 | 3031 | 2421 | 2801 |
| 15 | 2969 | 2426 | 2807 |
| 16 | 2877 | 2403 | 2785 |
| 17 | 2915 | 2403 | 2785 |
| 18 | 2914 | 2443 | 2823 |
| 19 | 2918 | 2421 | 2801 |

Mill products in the forms of, for example, plate, bars, sheet may be made from the alloys according to the present disclosure by processing including steps formulated with the foregoing observations and conclusions in mind in order to optimize hardness and ballistic performance of the alloy. As is understood by those having ordinary skill, a "plate" product has a thickness of at least 3/16 inch and a width of at least 10 inches, and a "sheet" product has a thickness no greater than 3/16 inch and a width of at least 10 inches. Those having ordinary skill will readily understand the differences between the various conventional mill products, such as plate, sheet and bar.

4. Cooling Tests a. Trial 1

Groups of 0.275×18×18 inch samples having the actual chemistry shown in Table 2 were processed through an austenitizing cycle by heating the samples at 1600±10° F. (871±6° C.) for 35 minutes±5 minutes, and were then cooled to room temperature using different methods to influence the cooling path. The cooled samples were then tempered for a defined time, and allowed to air cool to room temperature. The samples were Brinell hardness tested and ballistic tested. Ballistic $V_{50}$ values meeting the requirements under specification MIL-DTL-46100E were desired. Preferably, the ballistic performance as evaluated by ballistic $V_{50}$ values is no less 150 ft/sec less than the $V_{50}$ values required under specification MIL-A-46099C. In general, MIL-A-46099C requires significantly higher $V_{50}$ values that are generally 300-400 fps greater than required under MIL-DTL-46100E.

Figure 4:
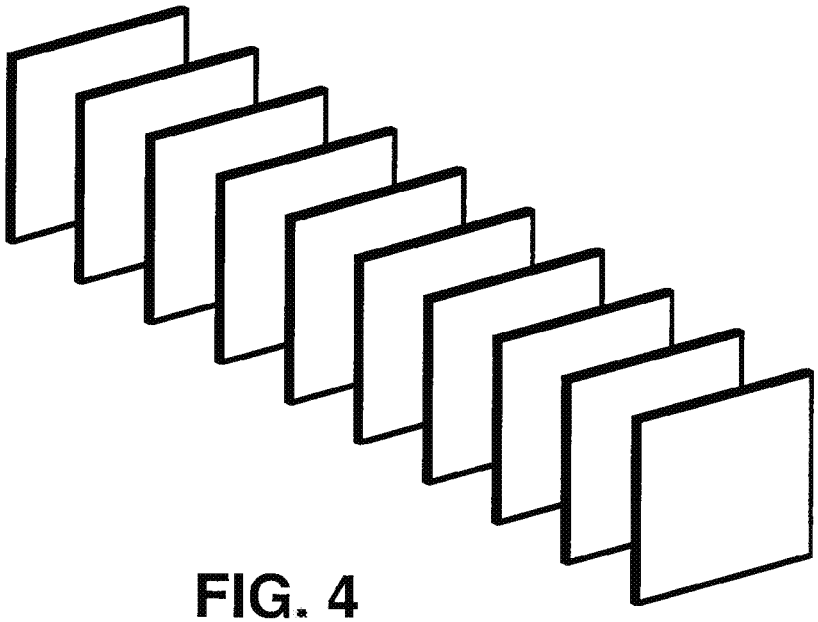
FIGS. 4, 5 and 7 are schematic representations of arrangements of test samples used during cooling from austenitizing temperature.

Table 9 lists hardness and $V_{50}$ results for samples cooled from the austenitizing temperature by vertically racking the samples on a cooling rack with 1 inch spacing between the samples and allowing the samples to cool to room temperature in still air in a room temperature environment. FIG. 4 schematically illustrates the stacking arrangement for these samples.

Table 10 provides hardness and $V_{50}$ values for samples cooled from the austenitizing temperature using the same general cooling conditions and the same vertical samples racking arrangement of the samples in Table 9, but wherein a cooling fan circulated room temperature air around the samples. Thus, the average rate at which the samples listed in Table 10 cooled from the austenitizing temperature exceeded that of the samples listed in Table 9.

Figure 5:
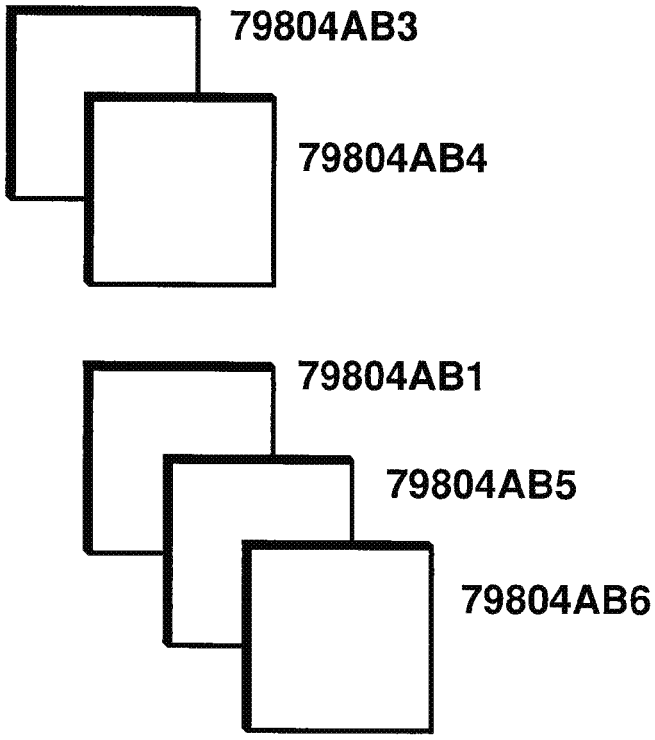
Figure 6:
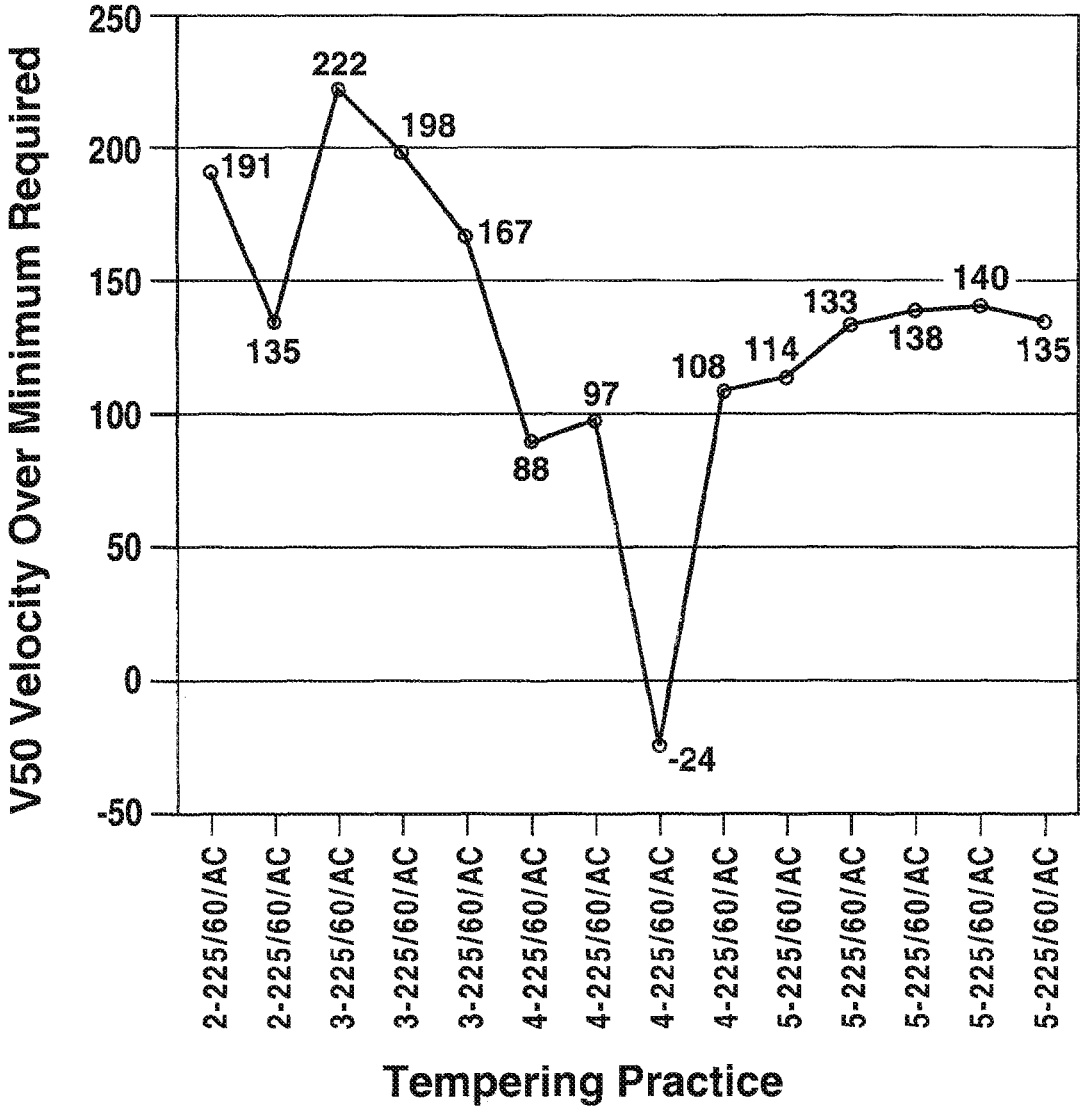
FIG. 6 is a plot of $V_{50}$ velocity over required minimum $V_{50}$ velocity (as per MIL-A-46099C) as a function of tempering practice for certain test samples.
Figure 7:
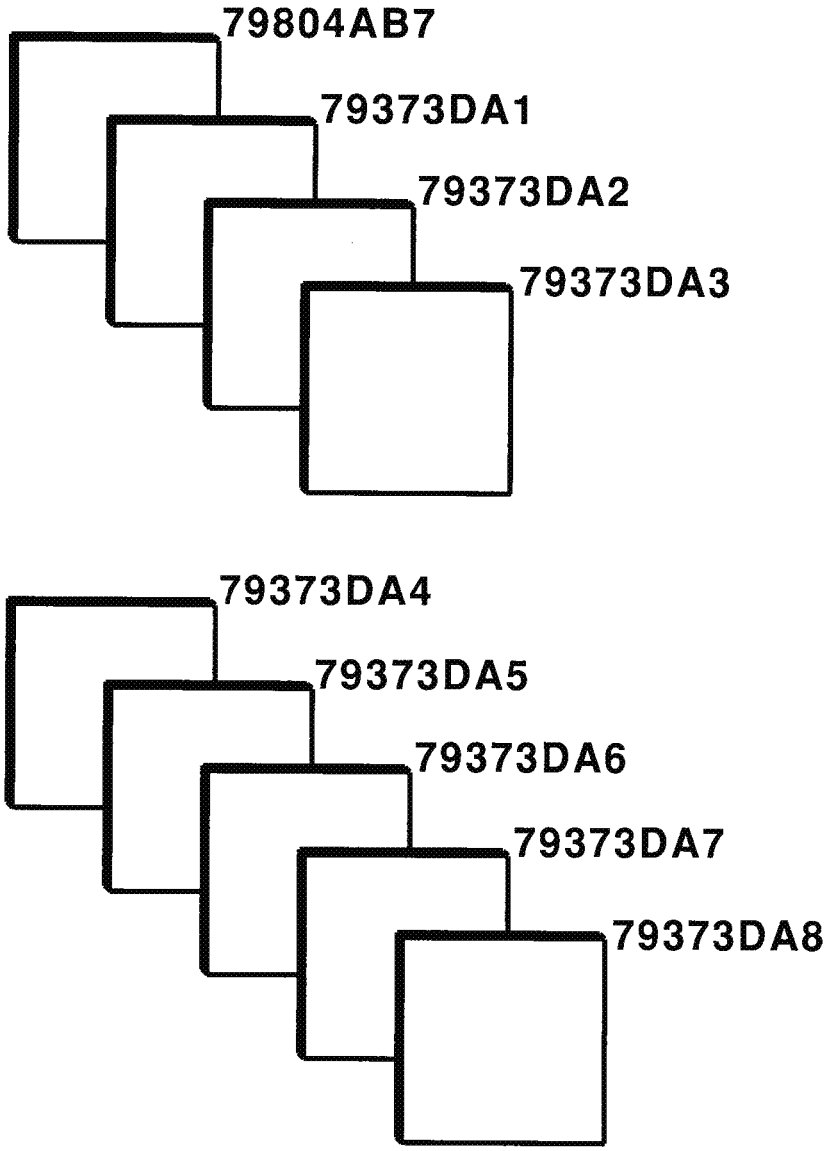
Figure 8:
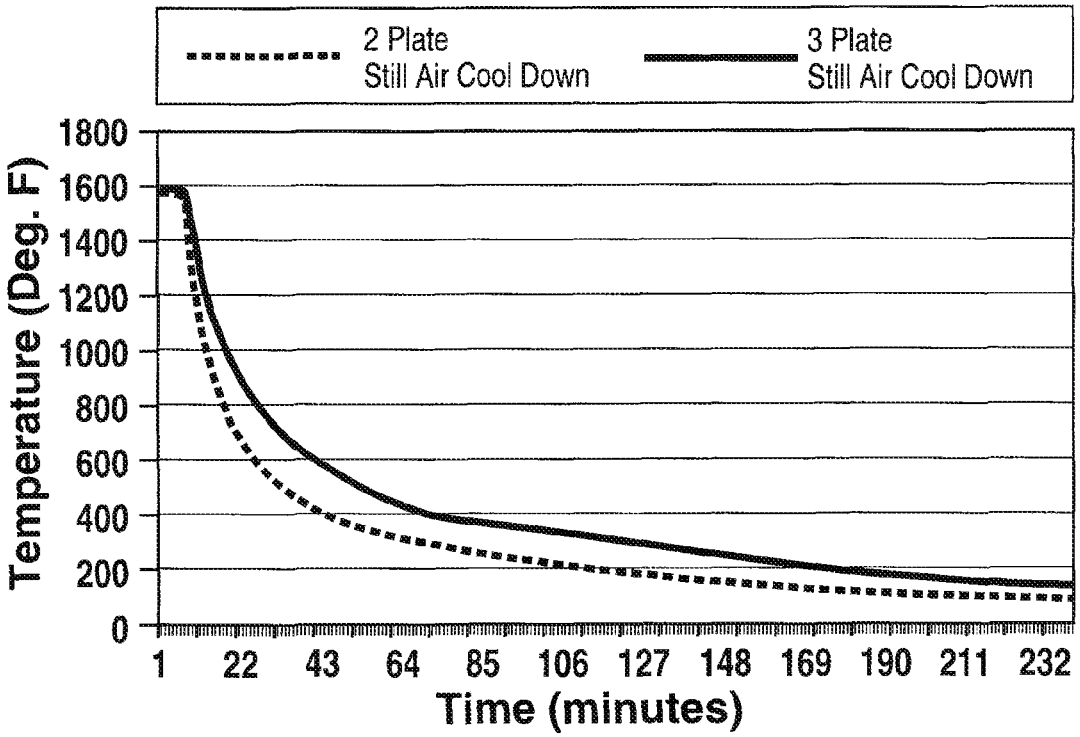
FIGS. 8 and 9 are plots of sample temperature over time during steps of cooling of certain test samples from an austenitizing temperature.
Figure 9:
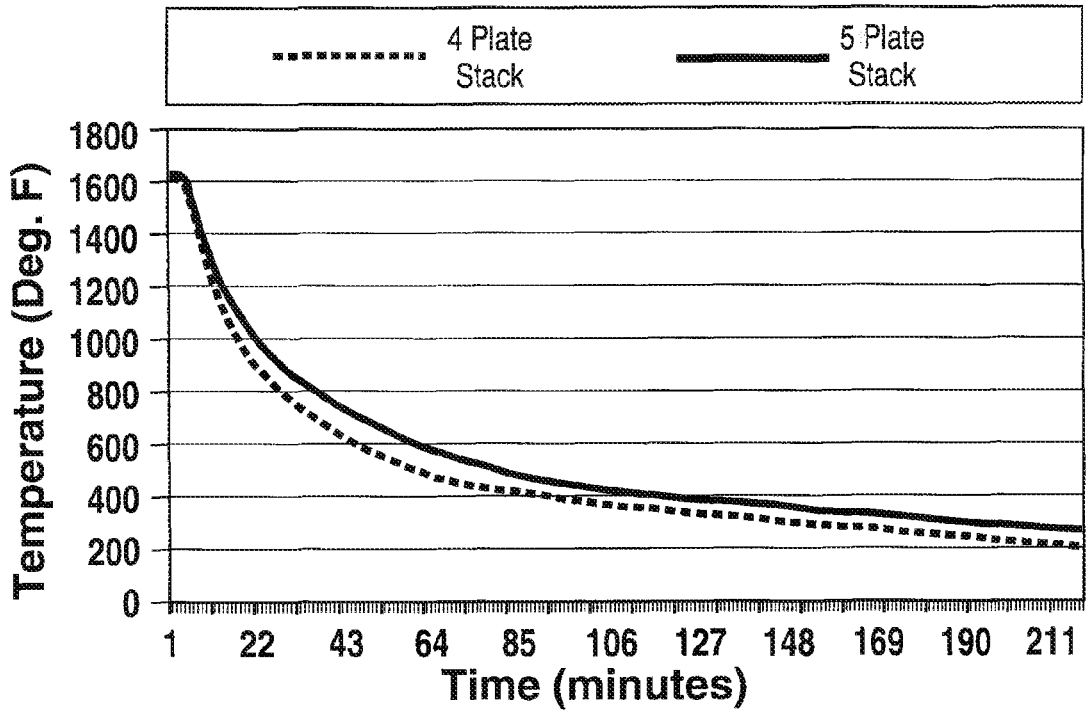

Table 11 lists hardnesses and $V_{50}$ results for still air-cooled samples arranged horizontally on the cooling rack and stacked in contact with adjacent samples so as to influence the rate at which the samples cooled from the austenitizing temperature. The $V_{50}$ values included in Table 11 are plotted as a function of tempering practice in FIG. 6. Four different stacking arrangements were used for the samples of Table 11. In one arrangement, shown on the top portion of FIG. 5, two samples were placed in contact with one another. In another arrangement, shown in the bottom portion of FIG. 5, three samples were placed in contact with one another. FIG. 8 is a plot of the cooling curves for the samples stacked as shown in the top and bottom portions of FIG. 5. FIG. 7 shows two additional stacking arrangements wherein either four plates (top portion) or five plates (bottom portion) were placed in contact with one another while cooling from the austenitizing temperature. FIG. 9 is a plot of the cooling curves for the samples stacked as shown in the top and bottom portions of FIG. 7. For each sample listed in Table 11, the second column of the table indicates the total number of samples associated in the stacking arrangement. It is expected that circulating air around the samples (versus, cooling in still air) and placing differing number of samples in contact with one another, as with the samples in Tables 9, 10, and 11, influenced the shape of the cooling curves for the various samples. In other words, it is expected that the particular paths followed by the cooling curves (i.e., the "shapes" of the curves) differed for the various arrangements of samples in Tables 9, 10, and 11. For example, the cooling rate in one or more regions of the cooling curve for a sample cooled in contact with other samples may be less than the cooling rate for a vertically racked, spaced-apart sample in the same cooling curve region. It is believed that the differences in cooling of the samples resulted in microstructural differences in the samples that unexpectedly influenced the ballistic penetration resistance of the samples, as discussed below.

Tables 9-11 identify the tempering treatment used with each sample listed in those tables. The $V_{50}$ results in Tables 9-11 are listed as a difference in feet/second (fps) relative to the required minimum $V_{50}$ velocity for the particular test sample size under specification MIL-A-46099C. As examples, a value of "−156" means that the $V_{50}$ for the sample, evaluated per the military specification using 7.62 mm (.30 caliber) armor piercing ammunition, was 156 fps less than the required value under the military specification, and a value of "+82" means that the $V_{50}$ velocity exceeded the required value by 82 fps. Thus, large, positive difference values are most desirable as they reflect ballistic penetration resistance that exceeds the required $V_{50}$ under the military specification. The $V_{50}$ values reported in Table 9 were estimated since the target plates cracked (degraded) during the ballistic testing. Ballistic results of samples listed in Tables 9 and 10 experienced a higher incidence of cracking.

TABLE 9

Still Air Cooled, Samples Racked Vertically with 1 Inch Spacing

| Sample | Temper Treatment (° F. temp/time-at-temp/cooling) | $V_{50}$ (46099C) (fps) | Average Hardness after Austen. (HBN) | Average Hardness after Temper (HBN) |
|---|---|---|---|---|
| 79804AB1 | 200/60/AC | — | 712 | 712 |
| 79804AB2 | 200/60/AC + | — | 712 | 712 |
| | 350/60/AC | +3 | 712 | 640 |
| 79804AB3 | 200/60/AC | — | 712 | 704 |
| 79804AB4 | 200/60/AC | — | 712 | 712 |
| 79804AB5 | 225/60/AC | — | 712 | 712 |
| 79804AB6 | 225/60/AC | — | 712 | 704 |
| 79804AB7 | 225/60/AC | — | 712 | 712 |
| 79804AB8 | 400/60/AC | −155 | 712 | 608 |
| 79804AB9 | 500/60/AC | −61 | 712 | 601 |
| 79804AB10 | 600/60/AC | −142 | 712 | 601 |

TABLE 10

Fan Cooled, Samples Racked Vertically with 1 Inch Spacing

| Sample | Temper Treatment (° F. temp/time-at-temp/cooling) | $V_{50}$ (estimated) (46099C) (fps) | Average Hardness after Austen. (HBN) | Average Hardness after Temper (HBN) |
|---|---|---|---|---|
| 79373AB1 | 200/60/AC | −95 | 712 | 675 |
| 79373AB2 | 200/120/AC | −47 | 712 | 675 |
| 79373AB3 | 225/60/AC | +35 | 712 | 668 |
| 79373AB4 | 225/120/AC | −227 | 712 | 682 |
| 79373AB5 | 250/60/AC | +82 | 712 | 682 |
| 79373AB6 | 250/120/AC | +39 | 712 | 682 |
| 79373AB7 | 275/60/AC | +82 | 712 | 682 |
| 79373AB8 | 275/120/AC | +13 | 712 | 675 |
| 79373AB9 | 300/60/AC | −54 | 712 | 675 |

TABLE 11

Still Air Cooled, Stacked Samples

| Sample | Stacking (no. of sample plates) | Temper Treatment (° F. temp/time-at-temp/cooling) | $V_{50}$ (46099C) (fps) | Average Hardness after Austen. (HBN) | Average Hardness after Temper (HBN) |
|---|---|---|---|---|---|
| 79804AB3 | 2 | 225/60/AC | +191 | 653 | 653 |
| 79804AB4 | 2 | 225/60/AC | +135 | 653 | 653 |
| 79804AB1 | 3 | 225/60/AC | +222 | 640 | 627 |
| 79804AB5 | 3 | 225/60/AC | +198 | 640 | 640 |
| 79804AB6 | 3 | 225/60/AC | +167 | 627 | 627 |
| 79804AB7 | 4 | 225/60/AC | +88 | 646 | 646 |
| 79373DA1 | 4 | 225/60/AC | +97 | 601 | 601 |
| 79373DA2 | 4 | 225/60/AC | −24 | 601 | 601 |
| 79373DA3 | 4 | 225/60/AC | +108 | 620 | 607 |
| 79373DA4 | 5 | 225/60/AC | +114 | 627 | 614 |
| 79373DA5 | 5 | 225/60/AC | +133 | 627 | 601 |
| 79373DA6 | 5 | 225/60/AC | +138 | 620 | 601 |
| 79373DA7 | 5 | 225/60/AC | +140 | 620 | 614 |
| 79373DA8 | 5 | 225/60/AC | +145 | 614 | 621 |

Hardness values for the samples listed in Table 11 were significantly less than those for the samples of Tables 9 and 10. This difference was believed to be a result of placing samples in contact with one another when cooling the samples from the austenitizing temperature, which modified the cooling curve of the samples relative to the "air quenched" samples referenced in Tables 9 and 10 and FIG. 4. The slower cooling used for samples in Table 11 is also thought to act to auto-temper the material during the cooling from the austenitizing temperature to room temperature.

As discussed above, the conventional belief is that increasing the hardness of a steel armor enhances the ability of the armor to fracture impacting projectiles, and thereby should improve ballistic performance as evaluated, for example, by $V_{50}$ velocity testing. The samples in Tables 9 and 10 were compositionally identical to those in Table 11 and, with the exception of the manner of cooling from the austenitizing temperature, were processed in substantially the same manner. Therefore, persons having ordinary skill in the production of steel armor materials would expect that the reduced surface hardness of the samples in Table 11 would negatively impact ballistic penetration resistance and result in lower $V_{50}$ velocities relative to the samples in Tables 9 and 10. Instead, the present inventors found that the samples of Table 11 unexpectedly demonstrated significantly improved penetration resistance, with a lower incidence of cracking while maintaining positive $V_{50}$ values. Considering the apparent improvement in ballistic properties in the experimental trials when tempering the steel after cooling from the austenitizing temperature, it is believed that in mill-scale runs it would be beneficial to temper at 250-450° F., and preferably at about 375° F., for about 1 hour after cooling from the austenitizing temperature.

The average $V_{50}$ velocity in Table 11 is 119.6 fps greater than the required $V_{50}$ velocity for the samples under MIL-A-46099C. Accordingly, the experimental data in Table 11 shows that embodiments of steel armors according to the present disclosure have $V_{50}$ velocities that approach or exceed the required values under MIL-A-46099C. In contrast, the average $V_{50}$ listed in Table 10 for the samples cooled at a higher rate was only 2 fps greater than that required under the specification, and the samples experienced unacceptable multi-hit crack resistance. Given that the $V_{50}$ velocity requirements of MIL-A-46099C are approximately 300-400 fps greater than under specification MIL-DTL-461000E, certain steel armor embodiments according to the present disclosure will also approach or meet the required values under MIL-DTL-46100E. Although in no way limiting to the invention in the present disclosure, the $V_{50}$ velocities preferably are no less than 150 ft/sec less than the required values under MIL-A-46099C. In other words, the $V_{50}$ velocities preferably are at least as great as a $V_{50}$150 ft/sec less than the required $V_{50}$ under specification MIL-A-46099C with minimal crack propagation The average penetration resistance performance of the embodiments of Table 11 is substantial and is believed to be at least comparable to certain more costly high alloy armor materials, or K-12® dual hardness armor plate. In sum, although the steel armor samples in Table 11 had significantly lower surface hardness than the samples in Tables 9 and 10, they unexpectedly demonstrated substantially greater ballistic penetration resistance, with reduced incidence to crack propagation, and is comparable to ballistic resistance of certain premium, high alloy armor alloys.

Without intending to be bound by an particular theory, the inventors believe that the unique composition of the steel armors according to the present disclosure and the non-conventional approach to cooling the armors from the austenitizing temperature are important to providing the steel armors with unexpectedly high penetration resistance. The inventors observed that the substantial ballistic performance of the samples in Table 11 was not merely a function of the samples' lower hardness relative to the samples in Tables 9 and 10. In fact, as shown in Table 12 below, certain of the samples in Table 9 had post-temper hardness that was substantially the same as the post-temper hardness of samples in Table 11, but the samples in Table 11, which were cooled from austenitizing temperature differently than the samples in Tables 9 and 10, had substantially higher $V_{50}$ velocities with lower incidence of cracking. Therefore, without intending to be bound by any particular theory of operation, it is believed that the significant improvement in penetration resistance in Table 11 may have resulted from an unexpected and significant microstructural change that occurred during the unconventional manner of cooling and additionally permitted the material to become auto-tempered while cooling to room temperature.

Although in the present trials the cooling curve was modified from that of a conventional air quench step by placing the samples in contact with one another in a horizontal orientation on the cooling rack, based on the inventors' observations discussed herein it is believed that other means of modifying the conventional cooling curve may be used to beneficially influence the ballistic performance of the alloys according to the present disclosure. Examples of possible ways to beneficially modify the cooling curve of the alloys include cooling from the austenitizing temperature in a controlled cooling zone or covering the alloy with a thermally insulating material such as, for example, Kaowool material, during all or a portion of the step of cooling the alloy from the austenitizing temperature.

TABLE 12

| Table 9 - Selected Samples | | Table 11 - Selected Samples | |
|---|---|---|---|
| Avg. Hardness after Temper (HBN) | $V_{50}$ (46099C) (fps) | Avg. Hardness after Temper (HBN) | $V_{50}$ (46099C) (fps) |
| 640 | +3 | 640 | +198 |
| 608 | −155 | 607 | +108 |
| 601 | −61 | 601 | +97 |
| 601 | −142 | 601 | −24 |
| | | 601 | +133 |
| | | 601 | +138 |

In light of advantages obtained by high hardness in armor applications, low alloy steels according to the present disclosure preferably have hardness of at least 550 HBN. Based on the foregoing test results and the present inventors' observation, steels according to the present invention preferably have hardness that is greater than 550 HBN and less than 700 HBN, and more preferably is greater than 550 HBN and less than 675. According to one particularly preferred embodiment, steels according to the present disclosure have hardness that is at least 600 HBN and is less than 675 HBN. Hardness likely plays an important role in establishing ballistic performance. However, the experimental armor alloys produced according to the present methods also derive their unexpected substantial penetration resistance from microstructural changes resulting from the unconventional manner of cooling the samples, which modified the samples' cooling curves from a curve characterizing a conventional step of cooling samples from austenitizing temperature in air.

b. Trial 2

Figure 10:
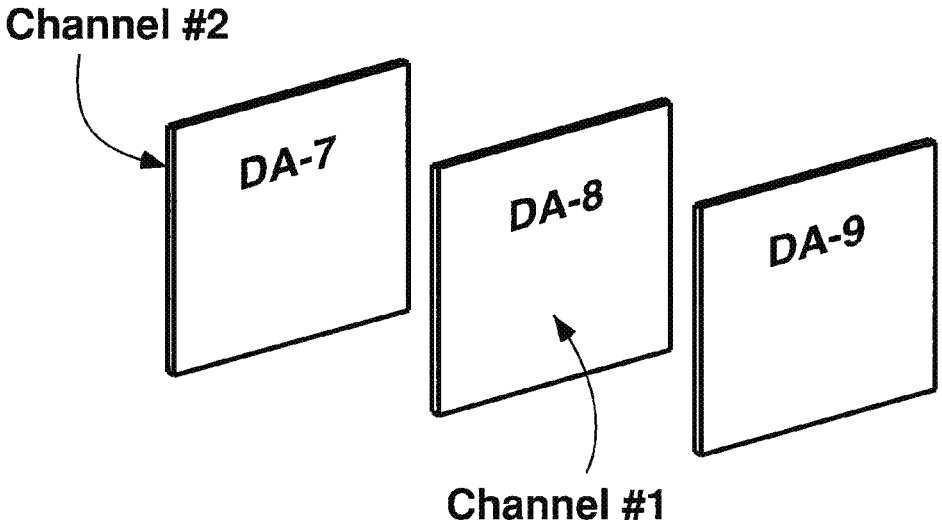
FIGS. 10 and 11 are schematic representations of arrangements of test samples used during cooling from austenitizing temperature.
Figure 11:
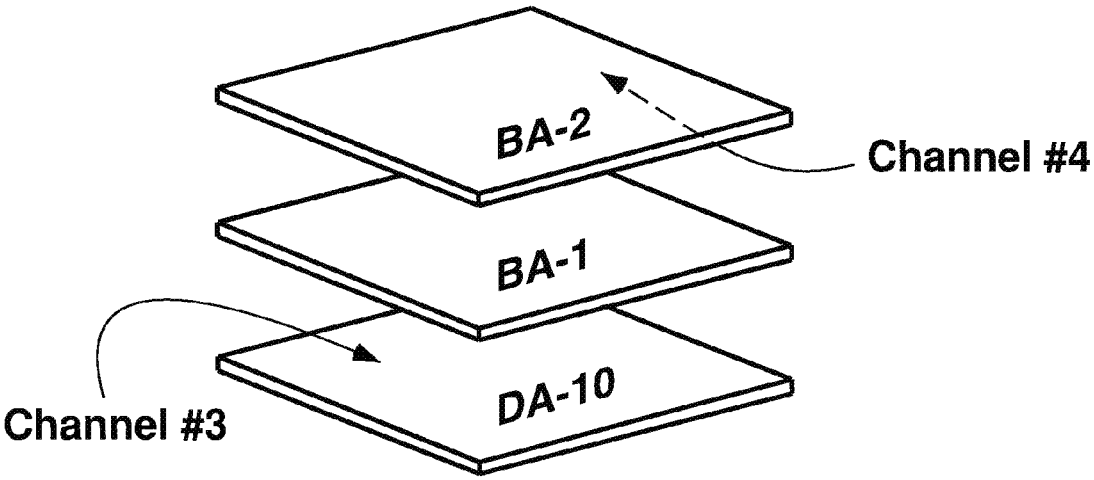

An experimental trial was conducted to investigate specific changes to the cooling curves of alloys cooled from the austenitizing temperature that may be at least partially responsible for the unexpected improvement in ballistic penetration resistance of alloys according to the present disclosure. Two groups of three 0.310 inch sample plates having the actual chemistry shown in Table 2 were heated to a 1600±10° F. (871±6° C.) austenitizing temperature for 35 minutes±5 minutes. The groups were organized on the furnace tray in two different arrangements to influence the cooling curve of the samples from the austenitizing temperature. In a first arrangement illustrated in FIG. 10, three samples (nos. DA-7, DA-8, and DA-9) were vertically racked with a minimum of 1 inch spacing between the samples. A first thermocouple (referred to as "channel 1") was positioned on the face of the middle sample (DA-8) of the racked samples. A second thermocouple (channel 2) was positioned on the outside face (i.e., not facing the middle plate) of an outer plate (DA-7). In a second arrangement, shown in FIG. 11, three samples were horizontally stacked in contact with one another, with sample no. DA-10 on the bottom, sample no. BA-2 on the top, and sample no. BA-1 in the middle. A first thermocouple (channel 3) was disposed on the top surface of the bottom sample, and a second thermocouple (channel 4) was disposed on the bottom surface of the top sample (opposite the top surface of the middle sample). After each arrangement of samples was heated to and held at the austenitizing temperature, the sample tray was removed from the furnace and allowed to cool in still air until the samples were below 300° F. (149° C.).

Hardness (HBN) was evaluated at corner locations of each sample after cooling the samples from the austenitizing temperature to room temperature, and again after each austenitized sample was tempered for 60 minutes at 225° F. (107° C.). Results are shown in Table 13.

TABLE 13

| Samples | Hardness (HBN) at Sample Corners after Cooling from Austenitizing Temperature | | | | Hardness (HBN) at Sample Corners after Tempering Treatment | | | |
|---|---|---|---|---|---|---|---|---|
| Vertically Stacked | | | | | | | | |
| DA-7 | 653 | 601 | 653 | 653 | 653 | 627 | 601 | 627 |
| DA-8 | 627 | 601 | 653 | 627 | 653 | 627 | 653 | 653 |

TABLE 13-continued

| Samples | Hardness (HBN) at Sample Corners after Cooling from Austenitizing Temperature | | | | Hardrness (HBN) at Sample Corners after Tempering Treatment | | | |
|---|---|---|---|---|---|---|---|---|
| DA-9 Horizontally Stacked | 653 | 653 | 653 | 627 | 601 | 627 | 601 | 627 |
| DA-10 (bottom) | 653 | 653 | 627 | 627 | 653 | 627 | 601 | 653 |
| BA-1 (middle) | 653 | 653 | 653 | 653 | 682 | 682 | 653 | 653 |
| BA-2 (top) | 712 | 653 | 653 | 653 | 653 | 653 | 653 | 653 |

Figure 12:
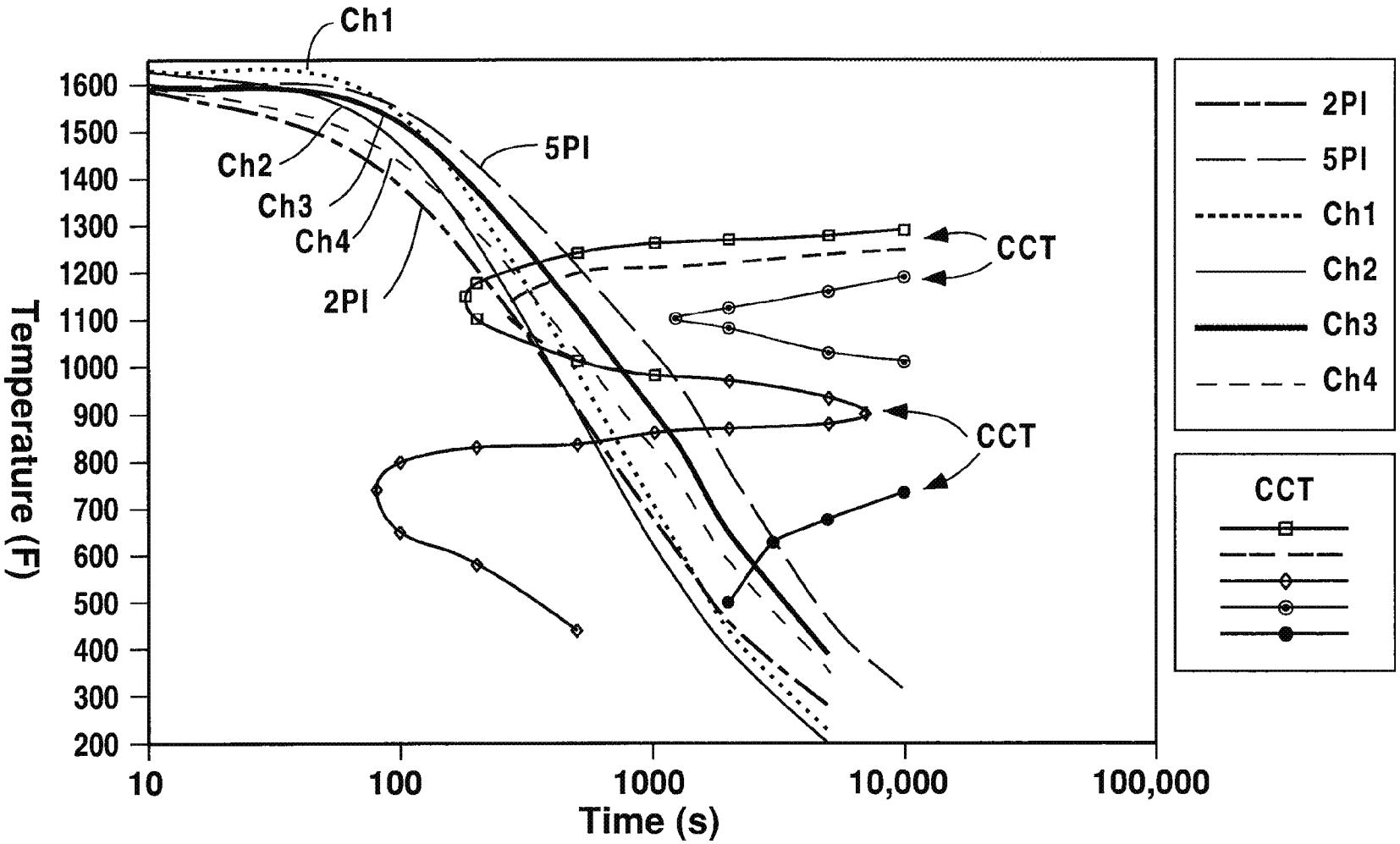
FIGS. 12-14 are graphs plotting samples temperature over time for several experimental samples cooled from austenitizing temperature, as discussed herein.
Figure 13:
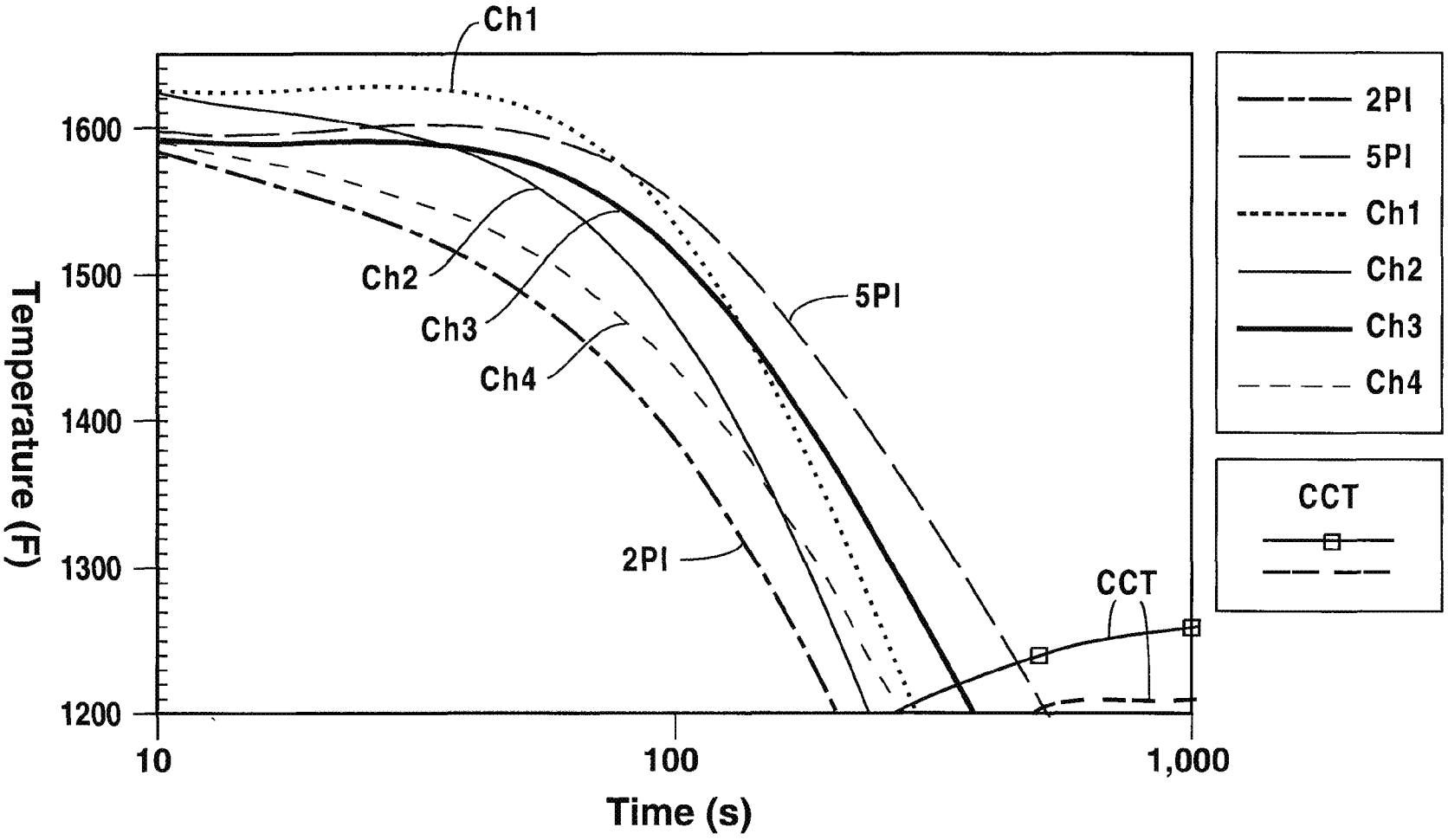
Figure 14:
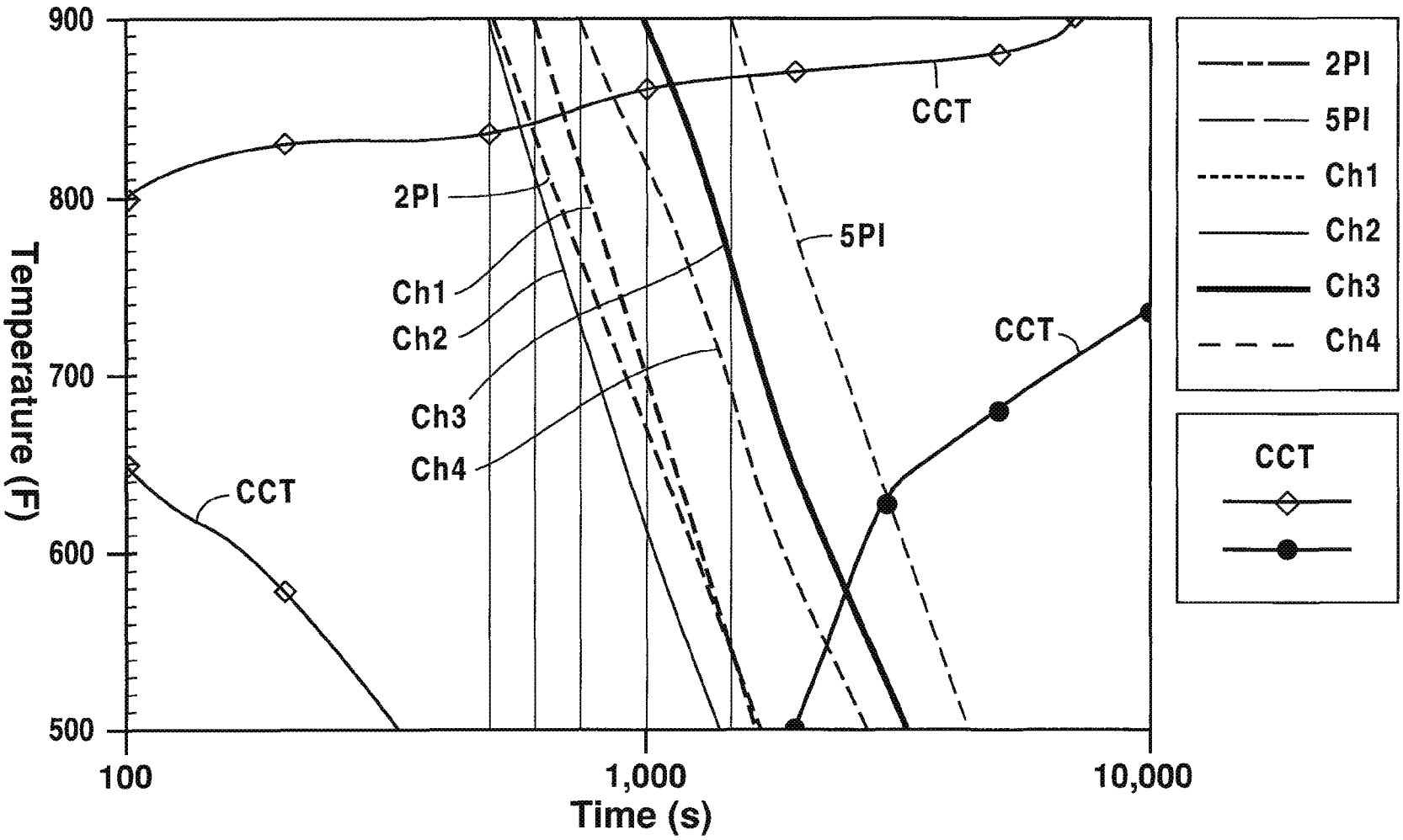

The cooling curve shown in FIG. 12 plots sample temperature recorded at each of channels 1-4 from a time just after the samples were removed from the austenitizing furnace until reaching a temperature in the range of about 200-400° F. (93-204° C.). FIG. 12 also shows a possible continuous cooling transformation (CCT) curve for the alloy, illustrating various phase regions for the alloy as it cools from high temperature. FIG. 13 shows a detailed view of a portion of the cooling curve of FIG. 11 including the region in which each of the cooling curves for channels 1-4 intersect the theoretical CCT curve. Likewise, FIG. 14 shows a portion of the cooling curve and CCT curves shown in FIG. 12, in the 500-900° F. (260-482° C.) sample temperature range. The cooling curves for channels 1 and 2 (the vertically racked samples) are similar to the curves for channels 3 and 4 (the stacked samples). However, the curves for channels 1 and 2 follow different paths than the curves for channels 3 and 4, and especially so in the early portion of the cooling curves (during the beginning of the cooling step). Subsequently, the shapes of the curves for channels 1 and 2 reflect a faster cooling rate than for channels 3 and 4. For example, in the region of the cooling curve in which the individual channel cooling curves first intersect the CCT curve, the cooling rate for channels 1 and 2 (vertically racked samples) was approximately 136° F./min (75.6° C./min), and for channels 3 and 4 (stacked samples) were approximately 98° F./min (54.4° C./min) and approximately 107° F./min (59.4° C./min), respectively. As would be expected, the cooling rates for channels 3 and 4 fall between the cooling rates measured for the cooling trials involving two stacked plates (111° F./min (61.7° C./min)) and 5 stacked plates (95° F./min (52.8° C./min)), discussed above. The cooling curves for the two stacked plate ("2Pl") and 5 stacked plate ("5Pl") cooling trials also are shown in FIGS. 12-14.

The cooling curves shown in FIGS. 12-14 for channels 1-4 suggest that all of the cooling rates did not substantially differ. As shown in FIGS. 12 and 13, however, each of the curves initially intersects the CCT curve at different points, indicating different amounts of transition, which may significantly affect the relative microstructures of the samples. The variation in the point of intersection of the CCT curve is largely determined by the degree of cooling that occurs while the sample is at high temperature. Therefore, the amount of cooling that occurs in the time period relatively soon after the sample is removed from the furnace may significantly affect the final microstructure of the samples, and this may in turn provide or contribute to the unexpected improvement in ballistic penetration resistance discussed herein. Therefore, the experimental trial confirmed that the manner in which the samples are cooled from the austenitizing temperature could influence alloy microstructure, and this may be at least partially responsible for the improved ballistic performance of armor alloys according to the present disclosure.

Steel armors according to the present disclosure would provide substantial value inasmuch as they can exhibit ballistic performance at least commensurate with premium, high alloy armor alloys, while including substantially lower levels of costly alloying ingredients such as, for example, nickel, molybdenum, and chromium. Given the performance and cost advantages of embodiments of steel armors according to the present disclosure, it is believed that such armors are a very substantial advance over many existing armor alloys.

The alloys plate and other mill products made according to the present disclosure may be used in conventional armor applications. Such applications include, for example, armored sheathing and other components for combat vehicles, armaments, armored doors and enclosures, and other article of manufacture requiring or benefiting from protection from projectile strikes, explosive blasts, and other high energy insults. These examples of possible applications for alloys according to the present disclosure are offered by way of example only, and are not exhaustive of all applications to which the present alloys may be applied. Those having ordinary skill, upon reading the present disclosure, will readily identify additional applications for the alloys described herein. It is believed that those having ordinary skill in the art will be capable of fabricating all such articles of manufacture from alloys according to the present disclosure based on knowledge existing within the art. Accordingly, further discussion of fabrication procedures for such articles of manufacture is unnecessary here.

Although the foregoing description has necessarily presented only a limited number of embodiments, those of ordinary skill in the relevant art will appreciate that various changes in the present alloys, methods, and articles of manufacture may be made by those skilled in the art, and all such modifications will remain within the principle and scope of the present disclosure as expressed herein and in the appended claims. It will also be appreciated by those skilled in the art that changes could be made to the embodiments above without departing from the broad inventive concept thereof. It is understood, therefore, that this invention is not limited to the particular embodiments disclosed, but is intended to cover modifications that are within the principle and scope of the invention, as defined by the claims.

We claim:

1. A method of making a mill product having hardness greater than 550 HBN, the method comprising:

providing a mill product including an alloy comprising, in weight percentages based on total alloy weight, 0.48 to 0.52 carbon, 0.15 to 1.00 manganese, 0.15 to 0.45 silicon, 0.95 to 1.70 chromium, 3.30 to 4.30 nickel, 0.35 to 0.65 molybdenum, 0.0008 to 0.0030 boron, 0.001 to 0.015 cerium, 0.001 to 0.015 lanthanum, no greater than 0.002 sulfur, no greater than 0.015 phosphorus, iron, and impurities;

austenitizing the alloy by heating the alloy at a temperature of at least 1500° F. (815° C.) for at least 30 minutes time-at-temperature; and cooling the alloy from the austenitizing temperature to room temperature in still air, wherein a plate of the alloy is stacked in contact with at least one adjacent plate of the alloy during the cooling so that the cooled alloy has a $V_{50}$ ballistic limit that is at least as great as the required $V_{50}$ under specification MIL-DTL-46100E.

2. The method of claim 1, wherein the mill product is selected from a plate, a sheet, and a bar.

3. The method of claim 1, wherein the mill product is selected from an armor plate, an armor sheet, and an armor bar.

4. The method of claim 1, wherein cooling the alloy provides the alloy with a $V_{50}$ ballistic limit that is at least as great as a $V_{50}$ ballistic limit 150 ft/sec less than the required $V_{50}$ under specification MIL-A-46099C.

5. The method of claim 1, wherein cooling the alloy provides the alloy with hardness greater than 550 HBN and less than 700 HBN.

6. The method of claim 1, wherein cooling the alloy provides the alloy with hardness greater than 550 HBN and less than 675 HBN.

7. The method of claim 1, wherein cooling the alloy provides the alloy with hardness that is at least 600 HBN and is less than 675 HBN.

8. The method of claim 1, wherein the alloy comprises 0.20 wt % to 1.00 wt % manganese.

9. The method of claim 1, wherein the alloy comprises no more than 0.15 wt % to 0.80 wt % manganese.

10. The method of claim 1, wherein the alloy comprises 0.20 wt % to 0.45 wt % silicon.

11. The method of claim 1, wherein the alloy comprises 0.15 wt % to 0.40 wt % silicon.

12. The method of claim 1, wherein the alloy comprises 1.00 wt % to 1.70 wt % chromium.

13. The method of claim 1, wherein the alloy comprises 0.95 wt % to 1.50 wt % chromium.

14. The method of claim 1, wherein the alloy comprises 3.75 wt % to 4.30 wt % nickel.

15. The method of claim 1, wherein the alloy comprises 3.30 wt % to 4.25 wt % nickel.

16. The method of claim 1, wherein the alloy comprises 0.40 wt % to 0.65 wt % molybdenum.

17. The method of claim 1, wherein the alloy comprises 0.35 wt % to 0.60 wt % molybdenum.

18. The alloy of claim 1, wherein the alloy comprises 0.0015 wt % to 0.0030 wt % boron.

19. The method of claim 1, wherein cooling the alloy provides the alloy with hardness that is at least 600 HBN and is less than 700 HBN and a $V_{50}$ ballistic limit that is at least as great as a V50 ballistic limit 150 ft/sec less than the required $V_{50}$ under specification MIL-A-46099C.

20. A method of making mill products selected from plates, sheets, and bars, the mill products comprising an alloy including, in weight percentages based on total alloy weight, 0.48 to 0.52 carbon, 0.15 to 1.00 manganese, 0.15 to 0.45 silicon, 0.95 to 1.70 chromium, 3.30 to 4.30 nickel, 0.35 to 0.65 molybdenum, 0.0008 to 0.0030 boron 0.001 to 0.015 cerium, 0.001 to 0.015 lanthanum, no greater than 0.002 sulfur, no greater than 0.015 phosphorus, no greater than 0.10 nitrogen, iron, and impurities, the method comprising:

austenitizing the alloy by heating at least two of the mill products at a temperature of at least 1500° F. (815° C.) for at least 30 minutes time-at-temperature; and cooling the at least two mill products from the austenitizing temperature arranged such that each mill product of the at least two mill products is in contact with at least one adjacent mill product of the at least two mill products;

wherein the cooled mill products have a hardness greater than 550 HBN.

21. The method of claim 20, wherein the cooled mill products comprise plates or sheets having a $V_{50}$ ballistic limit that is at least as great as a $V_{50}$ ballistic limit 150 ft/sec less than the required V50 under specification MIL-A-46099C.

22. The method of claim 20, wherein the cooled mill products have a hardness greater than 550 HBN and less than 700 HBN.

23. The method of claim 20, wherein the cooled mill products have a hardness greater than 550 HBN and less than 675 HBN.

24. The method of claim 20, wherein the cooled mill products have a hardness that is at least 600 HBN and is less than 675 HBN.

25. The method of claim 20, wherein the cooled mill products have a hardness that is at least 600 HBN and is less than 700 HBN, and a $V_{50}$ ballistic limit that is at least as great as a $V_{50}$ ballistic limit 150 ft/sec less than the required $V_{50}$ under specification MIL-A-46099C.

* * * * *